United States Patent [19]

Onitsuka et al.

[11] Patent Number: 5,041,821

[45] Date of Patent: Aug. 20, 1991

[54] FERROELECTRIC LIQUID CRYSTAL APPARATUS WITH TEMPERATURE DEPENDENT DC OFFSET VOLTAGE

[75] Inventors: Yoshihiro Onitsuka; Hiroshi Inoue, both of Yokohama; Osamu Taniguchi, Chigasaki; Atsushi Mizutome, Fujisawa; Tadashi Mihara, Atsugi; Akira Tsuboyama, Sagamihara, all of Japan

[73] Assignee: Canon Kabushiki Kaisha, Tokyo, Japan

[21] Appl. No.: 511,956

[22] Filed: Apr. 17, 1990

Related U.S. Application Data

[63] Continuation of Ser. No. 177,591, Apr. 4, 1988, abandoned.

[30] Foreign Application Priority Data

| | | | |
|---|---|---|---|
| Apr. 3, 1987 | [JP] | Japan | 62-083277 |
| Jun. 8, 1987 | [JP] | Japan | 62-143872 |
| Jun. 8, 1987 | [JP] | Japan | 62-143873 |
| Jun. 9, 1987 | [JP] | Japan | 62-144749 |

[51] Int. Cl.[5] ..... G09G 3/36

[52] U.S. Cl. ..... 340/784; 350/331 T; 350/333; 350/350 S

[58] Field of Search ..... 340/765, 784; 350/331 R, 331 T, 332, 333, 350 S

[56] References Cited

U.S. PATENT DOCUMENTS

| | | | |
|---|---|---|---|
| 4,367,924 | 1/1983 | Clark et al. | 350/350 S |
| 4,548,476 | 10/1985 | Kaneko | 350/350 S |
| 4,655,561 | 4/1987 | Kanbe et al. | 350/350 S |
| 4,668,051 | 5/1987 | Mourey et al. | 350/350 S |
| 4,697,887 | 10/1987 | Okada et al. | 350/350 S |
| 4,709,995 | 12/1987 | Kuribayashi et al. | 350/333 |
| 4,711,531 | 12/1987 | Masubuchi | 350/350 S |
| 4,712,872 | 12/1987 | Kanbe et al. | 350/350 S |
| 4,714,921 | 12/1987 | Kanno et al. | 340/784 |
| 4,715,688 | 12/1987 | Harada et al. | 350/350 S |
| 4,725,129 | 2/1988 | Kondo et al. | 350/333 |

*Primary Examiner*—Alvin E. Oberley
*Assistant Examiner*—Richard Hjerpe
*Attorney, Agent, or Firm*—Fitzpatrick, Cella, Harper & Scinto

[57] ABSTRACT

A liquid crystal apparatus, comprises: a liquid crystal device comprising scanning electrodes, data electrodes and a ferroelectric liquid crystal disposed between the scanning electrodes and the data electrodes; means for applying a scanning selection signal and a scanning nonselection signal to the scanning electrodes; means for applying data signals to the data electodes in phase with the scanning selection signal; and means for varying the average voltage values of the data signals during the period of applying a scanning selection signal.

21 Claims, 41 Drawing Sheets

| | | ODD FRAME F2M-1 (M=1,2,3···) | | EVEN FRAME F2M (M=1,2,3···) | |
|---|---|---|---|---|---|
| SCAN SELECTION SIGNAL (ODD) S2n-1 (n=1,2,3···) | | 2Vo, 0, -2Vo | | 2Vo, 0, -2Vo | |
| SCAN SELECTION SIGNAL (EVEN) S2n (n=1,2,3···) | | 2Vo, 0, -2Vo | | 2Vo, 0, -2Vo | |
| SCAN NON-SELECTION SIGNAL | | 0 | | 0 | |
| DATA SIGNAL | IN PHASE WITH S2n-1 | "W" | Vo, 0, -Vo | "B" | Vo, 0, -Vo |
| | | "H" | Vo, 0, -Vo | "H" | Vo, 0, -Vo |
| | IN PHASE WITH S2n | "B" | Vo, 0, -Vo | "W" | Vo, 0, -Vo |
| | | "H" | Vo, 0, -Vo | "H" | Vo, 0, -Vo |

FIG. 14A

| | | ODD FRAME F2M-1 (M=1,2,3···) | | EVEN FRAME F2M (M=1,2,3···) | |
|---|---|---|---|---|---|
| SCAN SELECTION SIGNAL S2n-1 (n=1,2,3···) | | 2Vo, 0, -2Vo | | 2Vo, 0, -2Vo | |
| SCAN SELECTION SIGNAL S2n (n=1,2,3···) | | 2Vo, 0, -2Vo | | 2Vo, 0, -2Vo | |
| SCAN NON-SELECTION SIGNAL | | 0 | | 0 | |
| DATA SIGNAL | IN PHASE WITH S2n-1 | "W" | Vo+VDC, 0, -Vo | "B" | Vo+VDC, 0, -Vo |
| | | "H" | Vo+VDC, 0, -Vo | "H" | Vo+VDC, 0, -Vo |
| | IN PHASE WITH S2n | "B" | Vo+VDC, 0, -Vo | "W" | Vo+VDC, 0, -Vo |
| | | "H" | Vo+VDC, 0, -Vo | "H" | Vo+VDC, 0, -Vo |

FIG. 14B

| | | ODD FRAME F2M-1 (M=1,2,3···) | | EVEN FRAME F2M (M=1,2,3···) | |
|---|---|---|---|---|---|
| SCAN SELECTION SIGNAL S2n-1 (n=1,2,3···) | | VDC+2Vo, 0, -VDC+2Vo | | VDC+2Vo, 0, -VDC+2Vo | |
| SCAN SELECTION SIGNAL S2n (n=1,2,3···) | | VDC+2Vo, 0, -VDC+2Vo | | VDC+2Vo, 0, -VDC+2Vo | |
| SCAN NON-SELECTION SIGNAL | | 0 | | 0 | |
| DATA SIGNAL | IN PHASE WITH S2n-1 | "W" | Vo, 0, -Vo | "B" | Vo, 0, -Vo |
| | | "H" | Vo, 0, -Vo | "H" | Vo, 0, -Vo |
| | IN PHASE WITH S2n | "B" | Vo, 0, -Vo | "W" | Vo, 0, -Vo |
| | | "H" | Vo, 0, -Vo | "H" | Vo, 0, -Vo |

FIG. 14C

| | | ODD FRAME F2M-1 (M=1,2,3···) | | EVEN FRAME F2M (M=1,2,3···) | |
|---|---|---|---|---|---|
| SCAN SELECTION SIGNAL S2n-1 (n=1,2,3···) | | 2Vo, 0, -2Vo | | 2Vo, 0, -2Vo | |
| SCAN SELECTION SIGNAL S2n (n=1,2,3···) | | 2Vo, 0, -2Vo | | 2Vo, 0, -2Vo | |
| SCAN NON-SELECTION SIGNAL | | 0 | | 0 | |
| DATA SIGNAL | IN PHASE WITH S2n-1 | "W" | Vo+VDC, 0, -Vo-VDC | "B" | Vo+VDC, 0, -Vo-VDC |
| | | "H" | Vo+VDC, 0, -Vo-VDC | "H" | Vo+VDC, 0, -Vo-VDC |
| | IN PHASE WITH S2n | "B" | Vo+VDC, 0, -Vo-VDC | "W" | Vo+VDC, 0, -Vo-VDC |
| | | "H" | Vo+VDC, 0, -Vo-VDC | "H" | Vo+VDC, 0, -Vo-VDC |

FIG. 14D

| | ODD FRAME F2M-1 (M=1,2,3···) | | EVEN FRAME F2M (M=1,2,3···) | |
|---|---|---|---|---|
| SCAN SELECTION SIGNAL Sn (n=1,2,3···) | 2Vo, 0, -2Vo | | 2Vo, 0, -2Vo | |
| SCAN NON-SELECTION SIGNAL | 0 | | 0 | |
| DATA SIGNAL | "W" | Vo, 0, -Vo | "B" | Vo, 0, -Vo |
| | "H" | Vo, 0, -Vo | "H" | Vo, 0, -Vo |

FIG. 15A

| | ODD FRAME F2M-1 (M=1,2,3···) | | EVEN FRAME F2M (M=1,2,3···) | |
|---|---|---|---|---|
| SCAN SELECTION SIGNAL Sn (n=1,2,3···) | 2Vo, 0, -2Vo | | 2Vo, 0, -2Vo | |
| SCAN NON-SELECTION SIGNAL | 0 | | 0 | |
| DATA SIGNAL | "W" | Vo+VDC, 0, -Vo | "B" | Vo+VDC, 0, -Vo |
| | "H" | Vo+VDC, 0, -Vo | "H" | Vo+VDC, 0, -Vo |

FIG. 15B

| | ODD FRAME F2M-1 (M=1,2,3···) | | EVEN FRAME F2M (M=1,2,3···) | |
|---|---|---|---|---|
| SCAN SELECTION SIGNAL Sn (n=1,2,3···) | VDC+2Vo<br>0<br>-VDC-2Vo | | VDC+2Vo<br>0<br>-VDC-2Vo | |
| SCAN NON-SELECTION SIGNAL | 0 | | 0 | |
| DATA SIGNAL | "W" | Vo<br>0<br>-Vo | "B" | Vo<br>0<br>-Vo |
| | "H" | Vo<br>0<br>-Vo | "H" | Vo<br>0<br>-Vo |

FIG. 15C

| | ODD FRAME F2M-1 (M=1,2,3···) | | EVEN FRAME F2M (M=1,2,3···) | |
|---|---|---|---|---|
| SCAN SELECTION SIGNAL Sn (n=1,2,3···) | 2Vo, 0, -2Vo | | 2Vo, 0, -2Vo | |
| SCAN NON-SELECTION SIGNAL | 0 | | 0 | |
| DATA SIGNAL | "W" | Vo+VDC, 0, -Vo-VDC | "B" | Vo+VDC, 0, -Vo-VDC |
| | "H" | Vo+VDC, 0, -Vo-VDC | "H" | Vo+VDC, 0, -Vo-VDC |

FIG. 15D

| | | ODD FRAME F2M-1 (M=1,2,3···) | | EVEN FRAME F2M (M=1,2,3···) | |
|---|---|---|---|---|---|
| SCAN SELECTION SIGNAL S2n-1 (n=1,2,3···) | | 2Vo, 0, -2Vo | | 2Vo, 0, -2Vo | |
| SCAN SELECTION SIGNAL S2n (n=1,2,3···) | | 2Vo, 0, -2Vo | | 2Vo, 0, -2Vo | |
| SCAN NON-SELECTION SIGNAL | | 0 | | 0 | |
| DATA SIGNAL | IN PHASE WITH S2n-1 | "W" | Vo, 0, -Vo | "B" | Vo, 0, -Vo |
| | | "H" | Vo, 0, -Vo | "H" | Vo, 0, -Vo |
| | IN PHASE WITH S2n | "B" | Vo, 0, -Vo | "W" | Vo, 0, -Vo |
| | | "H" | Vo, 0, -Vo | "H" | Vo, 0, -Vo |

FIG. 16A

| | | ODD FRAME F2M-1 (M=1,2,3···) | | EVEN FRAME F2M (M=1,2,3···) | |
|---|---|---|---|---|---|
| SCAN SELECTION SIGNAL S2n-1 (n=1,2,3···) | | 2Vo, 0, -2Vo | | 2Vo, 0, -2Vo | |
| SCAN SELECTION SIGNAL S2n (n=1,2,3···) | | 2Vo, 0, -2Vo | | 2Vo, 0, -2Vo | |
| SCAN NON-SELECTION SIGNAL | | 0 | | 0 | |
| DATA SIGNAL | IN PHASE WITH S2n-1 | "W" | Vo+VDC, 0, -Vo | "B" | Vo+VDC, 0, -Vo |
| | | "H" | Vo+VDC, 0, -Vo | "H" | Vo+VDC, 0, -Vo |
| | IN PHASE WITH S2n | "B" | Vo+VDC, 0, -Vo | "W" | Vo+VDC, 0, -Vo |
| | | "H" | Vo+VDC, 0, -Vo | "H" | Vo+VDC, 0, -Vo |

FIG. 16B

| | | ODD FRAME F2M-1 (M=1,2,3···) | | EVEN FRAME F2M (M=1,2,3···) | |
|---|---|---|---|---|---|
| SCAN SELECTION SIGNAL S2n-1 (n=1,2,3···) | | VDC+2Vo, 0, -VDC-2Vo | | VDC+2Vo, 0, -VDC-2Vo | |
| SCAN SELECTION SIGNAL S2n (n=1,2,3···) | | VDC+2Vo, 0, -VDC-2Vo | | VDC+2Vo, 0, -VDC-2Vo | |
| SCAN NON-SELECTION SIGNAL | | 0 | | 0 | |
| DATA SIGNAL | IN PHASE WITH S2n-1 | "W" | Vo, 0, -Vo | "B" | Vo, 0, -Vo |
| | | "H" | Vo, 0, -Vo | "H" | Vo, 0, -Vo |
| | IN PHASE WITH S2n | "B" | Vo, 0, -Vo | "W" | Vo, 0, -Vo |
| | | "H" | Vo, 0, -Vo | "H" | Vo, 0, -Vo |

FIG. 16C

| | | ODD FRAME F2M-1 (M=1,2,3···) | | EVEN FRAME F2M (M=1,2,3···) | |
|---|---|---|---|---|---|
| SCAN SELECTION SIGNAL S2n-1 (n=1,2,3···) | | 2Vo, 0, -2Vo | | 2Vo, 0, -2Vo | |
| SCAN SELECTION SIGNAL S2n (n=1,2,3···) | | 2Vo, 0, -2Vo | | 2Vo, 0, -2Vo | |
| SCAN NON-SELECTION SIGNAL | | 0 | | 0 | |
| DATA SIGNAL | IN PHASE WITH S2n-1 | "W" | Vo+VDC, 0, -Vo-VDC | "B" | Vo+VDC, 0, -Vo-VDC |
| | | "H" | Vo+VDC, 0, -Vo-VDC | "H" | Vo+VDC, 0, -Vo-VDC |
| | IN PHASE WITH S2n | "B" | Vo+VDC, 0, -Vo-VDC | "W" | Vo+VDC, 0, -Vo-VDC |
| | | "H" | Vo+VDC, 0, -Vo-VDC | "H" | Vo+VDC, 0, -Vo-VDC |

FIG. 16D

| | | ODD FRAME F2M-1 (M=1,2,3···) | | EVEN FRAME F2M (M=1,2,3···) | |
|---|---|---|---|---|---|
| SCAN SELECTION SIGNAL S2n-1 (n=1,2,3···) | | 2Vo, 0, -2Vo | | 2Vo, 0, -2Vo | |
| SCAN SELECTION SIGNAL S2n (n=1,2,3···) | | 2Vo, 0, -2Vo | | 2Vo, 0, -2Vo | |
| SCAN NON-SELECTION SIGNAL | | 0 | | 0 | |
| DATA SIGNAL | IN PHASE WITH S2n-1 | "W" | Vo+VDC, 0, -Vo | "B" | Vo, 0, -Vo-VDC |
| | | "H" | Vo+VDC, 0, -Vo | "H" | Vo, 0, -Vo-VDC |
| | IN PHASE WITH S2n | "B" | Vo, 0, -Vo-VDC | "W" | Vo+VDC, 0, -Vo |
| | | "H" | Vo, 0, -Vo-VDC | "H" | Vo+VDC, 0, -Vo |

FIG. 23

| | | ODD FRAME F2M-1 (M=1,2,3···) | | EVEN FRAME F2M (M=1,2,3···) | |
|---|---|---|---|---|---|
| SCAN SELECTION SIGNAL S2n-1 (n=1,2,3···) | | 2Vo, 0, -2Vo | | 2Vo, 0, -2Vo | |
| SCAN SELECTION SIGNAL S2n (n=1,2,3···) | | 2Vo, 0, -2Vo | | 2Vo, 0, -2Vo | |
| SCAN NON-SELECTION SIGNAL | | 0 | | 0 | |
| DATA SIGNAL | IN PHASE WITH S2n-1 | "W" | Vo+VDC, 0, -Vo | "B" | Vo, 0, -Vo-VDC |
| | | "H" | Vo+VDC, 0, -Vo | "H" | Vo, 0, -Vo-VDC |
| | IN PHASE WITH S2n | "B" | Vo, 0, -Vo-VDC | "W" | Vo+VDC, 0, -Vo |
| | | "H" | Vo, 0, -Vo-VDC | "H" | Vo+VDC, 0, -Vo |

FIG. 24

FERROELECTRIC LIQUID CRYSTAL APPARATUS WITH TEMPERATURE DEPENDENT DC OFFSET VOLTAGE

This application is a continuation-in-part continuation of application Ser. No. 07/177,591, filed April 4, 1988, now abandoned.

FIELD OF THE INVENTION AND RELATED ART

The present invention relates to a liquid crystal apparatus, such as a display panel or a shutter-array printer, using a ferroelectric liquid crystal.

Hitherto, there has been well-known a type of liquid crystal display devices which comprise a group of scanning electrodes and a group of signal or data electrodes arranged in a matrix, and a liquid crystal compound is filled between the electrode groups to form a large number of pixels thereby to display images or information.

These display devices are driven by a multiplexing driving method wherein an address signal is selectively applied sequentially and periodically to the group of scanning electrodes, and prescribed data signals are parallely and selectively applied to the group of data electrodes in synchronism with the address signals.

In most of the practical devices of the type described above, TN (twisted nematic)-type liquid crystals have been used as described in "Voltage-Dependent Optical Activity of a Twisted Nematic Liquid Crystal" by M. Schadt and W. Helfrich, Applied Physics Letters, Vol. 18, No. 4, pp. 127-128.

In recent years, the use of a liquid crystal device showing bistability has been proposed by Clark and Lagerwall as an improvement to the conventional liquid crystal devices in U.S. Pat. No. 4,367,924; JA-A (Kokai) 56-107216; etc. As the bistable liquid crystal, a ferroelectric liquid crystal showing chiral smectic C phase (SmC*) or H phase (SmH*) is generally used. The ferroelectric liquid crystal assumes either a first optically stable state or a second optically stable state in response to an electric field applied thereto and retains the resultant state in the absence of an electric field, thus showing a bistability. Further, the ferroelectric liquid crystal quickly responds to a change in electric field, and thus the ferroelectric liquid crystal device is expected to be widely used in the field of a high-speed and memory-type display apparatus, etc.

The switching between the first stable state and the second stable state is caused by application of a pulse exceeding a threshold determined by the duration (width) and the voltage amplitude of the pulse, e.g., when rectangular pulses are used. Accordingly, multiplexing drive is effected by applying appropriate pulses including a pulse exceeding the threshold applied to selected pixels among the pixels formed at the intersections of the scanning electrodes and data electrodes and a pulse below the threshold applied to the other pixels.

Such multiplexing device systems have been disclosed in, e.g., U.S. Pat. Nos. 4,548,476; 4,655,561; 4,697,887; 4,709,995; 4,712,872; and 4,714,921.

The threshold characteristic of the above-mentioned ferroelectric liquid crystal device is largely dependent on temperature. For this reason, it has been proposed to use a lower driving voltage at a higher temperature than the driving voltage at a lower temperature or to use a higher driving frequency (higher frame frequency) at a higher temperature than the driving frequency at a lower temperature for multiplexing drive of such a ferroelectric liquid crystal device, as proposed, e.g., in European Patent Publication EP-A 149899.

However, in such a temperature compensation method wherein the driving voltage is varied corresponding to temperature change, a very large driving voltage is required at a low temperature, so that the driving circuit therefor becomes expensive. On the other hand, in the temperature compensation method wherein the driving frequency is changed corresponding to temperature change, the frame frequency is lowered at a low temperature so that the writing speed is lowered and flickering becomes noticeable.

In the multiplexing drive system, the 1/a bias scheme (e.g., ⅓ bias scheme) has been most frequently used as a voltage-averaging method with little cross-talk. According to the 1/a bias scheme, four levels of voltages are applied to pixels depending on combination of selection or non-selection of scanning lines and data lines. More specifically, a pixel on a scanning line and a data line both selected ("selection state") is supplied with a driving voltage having a peak value $V_0$ ($V_0$=a constant supply voltage); a pixel on a selected scanning line and a non-selected data line ("half-selection state") is supplied with a driving voltage having a peak value of $(1-2/a)V_0$; and a pixel on a non-selected scanning line ("non-selection state") is supplied with a driving voltage having a peak value of $V_0/a$ regardless of whether it is on a selected data line or a non-selected data line. As a result, during one frame period (one cycle period) of multiplexing drive, a pixel in the selection state receives a larger effective value of driving voltage than a pixel in the non-selection state. The difference in effective value provides a difference in transmitted or reflected light intensity, i.e., a contrast, to effect a display.

Incidentally, in the multiplexing drive, a pixel is supplied with a writing pulse exceeding the threshold voltage in the selection state and is thereafter supplied with a train of pulses having a voltage value which is 1/a times that of the writing pulse depending on data signals in the subsequent non-selection state. Depending on the state of the pulse train applied in the non-selection state, however, it is possible that some pixel supplied with a writing pulse at the time of selection does not cause inversion, or in other words that a pixel supplied with a writing pulse is once inverted at the time of writing but is re-inverted as it is continually supplied with the pulse train having a 1/a voltage in the subsequent period of non-selection. This phenomenon is generally referred to as "cross-talk". A display picture having caused such a cross-talk phenomenon does not provide a sufficient contrast and fails to provide a good display quality.

In view of the above problem, U.S. Pat. No. 4,655,561 has proposed a method wherein a DC voltage component is superposed on an AC driving voltage applied at intersections between the scanning line and data lines to prevent the above-mentioned cross-talk phenomenon.

Further, a ferroelectric liquid crystal device has a memory effect, which however is not always symmetrical between the first and second orientation states. In an extreme case, bistability is not attained but monostability of only one state being stable results, whereby a display quality at the time of switching is deteriorated. It has been proposed to prevent the nonstability by superposing a DC voltage component (DC bias).

However, if the DC bias is too small, the display quality is not sufficiently improved. On the other hand, if the DC bias is too large, the bistability of a ferroelectric liquid crystal is completely destroyed to result in reverse monostability or the alignment of the liquid crystal per se is destroyed in an extreme case.

Hitherto, the DC bias has been optimized with the above matters taken into consideration. In the case of a ferroelectric liquid crystal which changes driving characteristics remarkably depending on temperature change, however, the driving temperature range has been restricted thereby.

SUMMARY OF THE INVENTION

An object of the present invention is to provide a liquid crystal apparatus having solved the above problems.

A specific object of the present invention is to provide a liquid crystal apparatus capable of temperature compensation over a whole operation temperature range without increasing the amount of variation in frame frequency or driving voltage.

Another object of the present invention is to provide a ferroelectric liquid crystal apparatus having driving characteristics with bistability for a long term.

Still another object of the present invention is to provide a driving method for realizing a good image quality while preventing occurrence of cross-talk.

According to the present invention, there is provided a liquid crystal apparatus, comprising: a liquid crystal device comprising scanning electrodes, data electrodes and a ferroelectric liquid crystal disposed between the scanning electrodes and the data electrodes; means for applying a scanning selection signal and a scanning nonselection signal to the scanning electrodes; means for applying data signals to the data electrodes in phase with the scanning selection signal; and means for varying the average voltage values of the data signal during the period of applying a scanning selection signal.

According to a preferred embodiment of the present invention, there is provided a liquid crystal apparatus, comprising: a liquid crystal device comprising scanning electrodes, data electrodes and a ferroelectric liquid crystal disposed between the scanning electrodes and the data electrodes; means for applying a scanning selection signal and a scanning nonselection signal to the scanning electrodes, said scanning selection signal having a voltage of one polarity and a voltage of the other polarity with respect to the voltage level of the scanning nonselection signal; means for applying to all or a prescribed number of the data electrodes a voltage signal providing a voltage exceeding the threshold voltage on one side of the ferroelectric liquid crystal in combination with and in phase with said voltage of one polarity, applying to a selected data electrode a voltage signal providing a voltage exceeding the threshold voltage on the other side of the ferroelectric liquid crystal in combination with and in phase with said voltage of the other polarity, and applying to the other data electrodes a voltage signal providing a voltage between the threshold voltages on one and the other sides of the ferroelectric liquid crystal in combination with and in phase with said voltage of the other polarity; and means for varying the average voltage value of the voltage signals applied to the data electrodes during the period of applying a scanning selection signal.

According to another preferred embodiment of the invention, there is provided a liquid crystal apparatus, comprising: a liquid crystal device comprising scanning electrodes, data electrodes and a ferroelectric liquid crystal disposed between the scanning electrodes and the data electrodes; means for applying a voltage exceeding the threshold voltage on one side of the ferroelectric liquid crystal to the intersections of all or a prescribed number of the scanning electrodes and the data electrodes; means for applying a scanning selection signal and a scanning nonselection signal to the scanning electrodes, means for applying to a selected data electrode a voltage signal providing a voltage exceeding the threshold voltage on the other side of the ferroelectric liquid crystal in combination with and in phase with said voltage of the other polarity, and applying to the other data electrodes a voltage signal providing a voltage between the threshold voltages on one and the other sides of the ferroelectric liquid crystal in combination with and in phase with said voltage of the other polarity; and means for varying the average voltage value of the voltage signals applied to the data electrodes during the period of applying a scanning selection signal.

Secondly, we have made an extensive study on the relationship between the above-mentioned DC bias and temperature in multiplexing drive of a ferroelectric liquid crystal device. As a result, we have succeeded in enlarging the temperature range adapted for driving to a level practically free of problem. Thus, according to a second aspect of the invention, there is provided, in a liquid crystal apparatus, comprising a liquid crystal device comprising scanning lines, data lines, and a ferroelectric liquid crystal disposed between the scanning lines and the data lines, and means for superposing a DC component on a driving AC voltage applied to the intersections of the scanning lines and the data lines; an improvement comprising: means for varying the magnitude of the DC component depending on a temperature change. Particularly, in the invention, the above objects may be accomplished by setting a smaller DC bias at a lower temperature and increasing the DC bias as the temperature increases.

According to a third aspect of the invention, there is provided, in liquid crystal apparatus, comprising: a liquid crystal device comprising scanning electrodes, data electrodes and a ferroelectric liquid crystal disposed between the scanning electrodes and the data electrodes; and voltage application means for applying a scanning selection signal to the scanning electrodes and applying data signals to the data electrodes in phase with the scanning selection signal; an improvement wherein said voltage application means including means for superposing a DC voltage on an AC voltage applied to the intersections of the scanning electrodes and data electrodes and inverting the polarity of the DC voltage with respect to the voltage level of a non-selected scanning electrode for each prescribed period.

According to a fourth aspect of the invention, there is provided a driving method for a ferroelectric liquid crystal device comprising a matrix electrode arrangement including scanning electrodes and data electrodes intersecting with the scanning electrodes so as to form a pixel at each intersection, and a ferroelectric liquid crystal showing bi-stable or multi-stable states disposed between the scanning electrodes and the data electrodes; said driving method comprising: applying to the ferroelectric liquid crystal driving pulses having a minimum unit pulse duration of $\Delta T$, said driving pulses including a writing pulse applied to the ferroelectric liquid crystal at a pixel for causing switching between the stable states and holding pulses applied to the ferroelectric liquid crystal at the pixel for holding the resultant state of the ferroelectric liquid crystal after the switching, said holding pulses including three or more continuous or discontinuous pulses with a pulse duration of $\Delta T$ or longer having a polarity opposite to that of the writing pulse; wherein the average voltage value applied to the liquid crystal in a prescribed period is set to the same polarity side as the writing pulse.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIGS. 14A–14D, FIGS. 15A–15D and FIGS. 16A–16D show other sets of driving voltage waveforms used in the invention;

FIGS. 22, 23 and 24 show other sets of driving voltage waveforms used in the invention;

DESCRIPTION OF PREFERRED EMBODIMENTS

Figure 10:
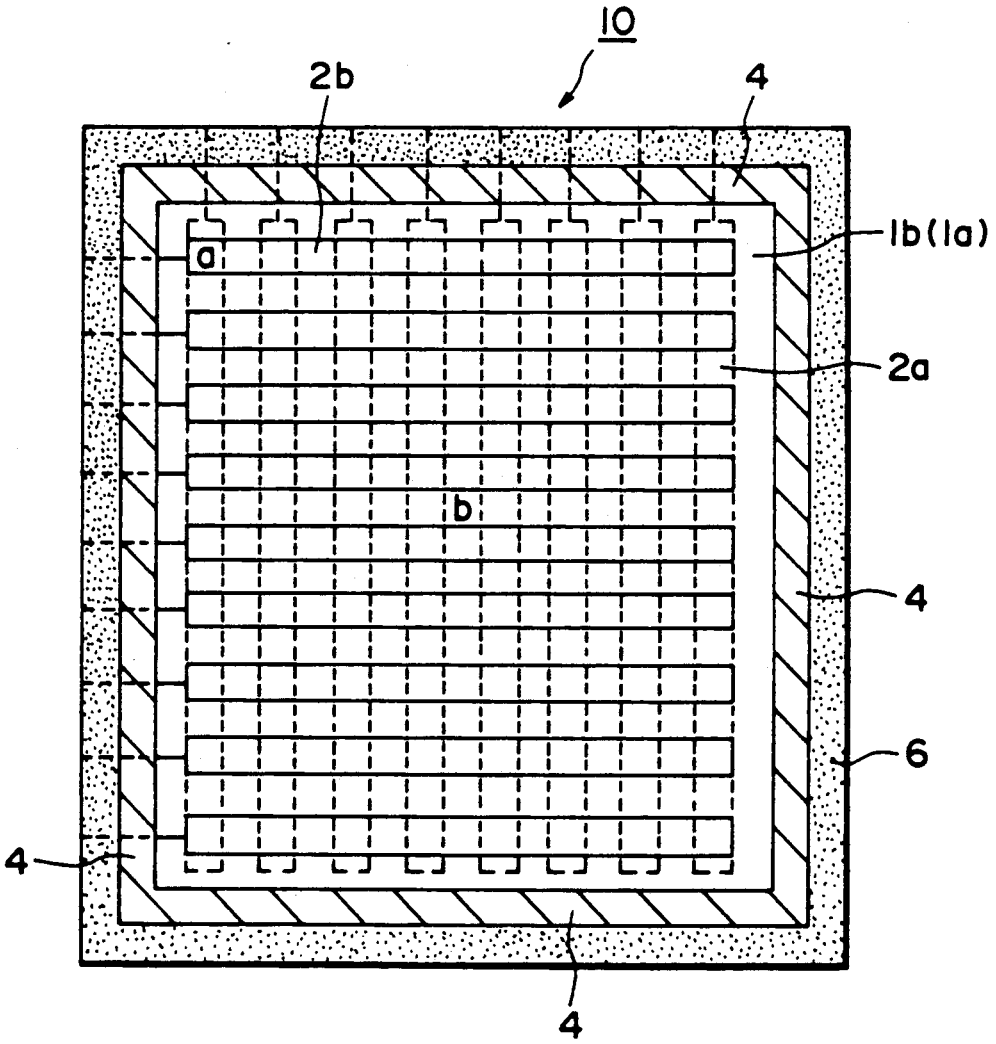
FIG. 10 is a plan view of an FLC device used in the present invention.

FIG. 10 is a schematic plan view showing matrix electrode arrangement of a cell enclosing a ferroelectric liquid crystal.

A cell structure 10 shown in FIG. 10 comprises a pair of glass substrates 1*a* and 1*b* disposed with a prescribed spacing therebetween by means of spacers 4, and the pair of substrates are bonded to each other with an adhesive 6 at the periphery thereof for sealing to provide a cell structure. On the substrate 1*a* are disposed a plurality of transparent electrodes 2*a* in the form of stripes so as to form a group of electrodes (e.g., a group of electrodes for applying a scanning voltage of the matrix electrode arrangement). On the other hand, on the substrate 1*b* are disposed a plurality of transparent electrodes 2*b* intersecting with the above-mentioned transparent electrodes 2*a* so as to form another group of electrodes (e.g., a group of electrodes for applying data voltages of the matrix electrode arrangement). Each substrate provided with transparent electrodes is coated with an inorganic insulating film of $SiO_2$ and an organic alignment film of polyvinyl alcohol (PVA), the surface of which has been subjected to a rubbing treatment. In a specific embodiment, an ester-type mixture liquid crystal ("CS 1014" available from Chisso K.K.) showing the following phase transition series including a smectic phase was used:

$$\text{Iso.} \xleftarrow[80.5^\circ\text{ C.}]{} \text{Ch.} \xleftarrow[69.1^\circ\text{ C.}]{} \text{SmA} \xleftarrow[54.4^\circ\text{ C.}]{} \text{SmC*} \xleftarrow[-21^\circ\text{ C.}]{} \text{Crystal,}$$

wherein Iso denotes isotropic phase; Ch, cholesteric phase; SmA, smectic A phase; and SmC*, chiral smectic C phase).

Figure 1:
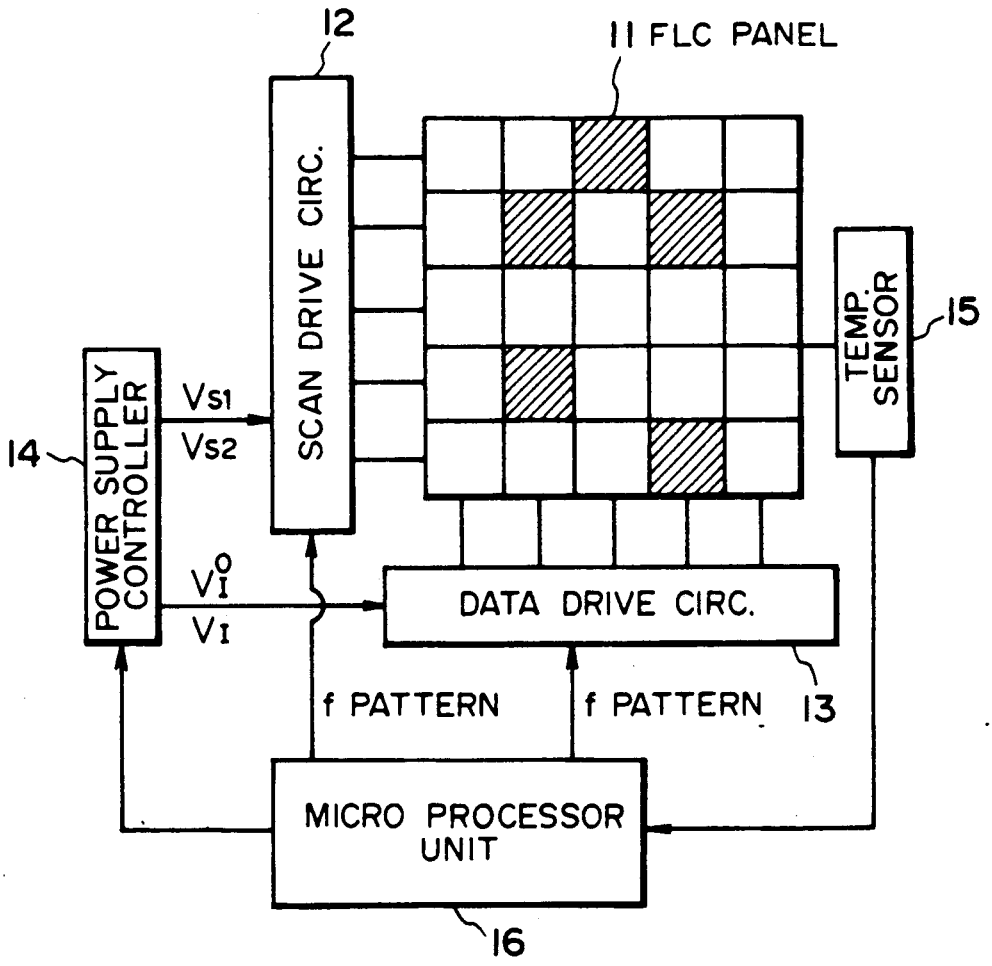
FIG. 1 is a block diagram for illustrating a liquid crystal apparatus according to the present invention.
Figure 2:
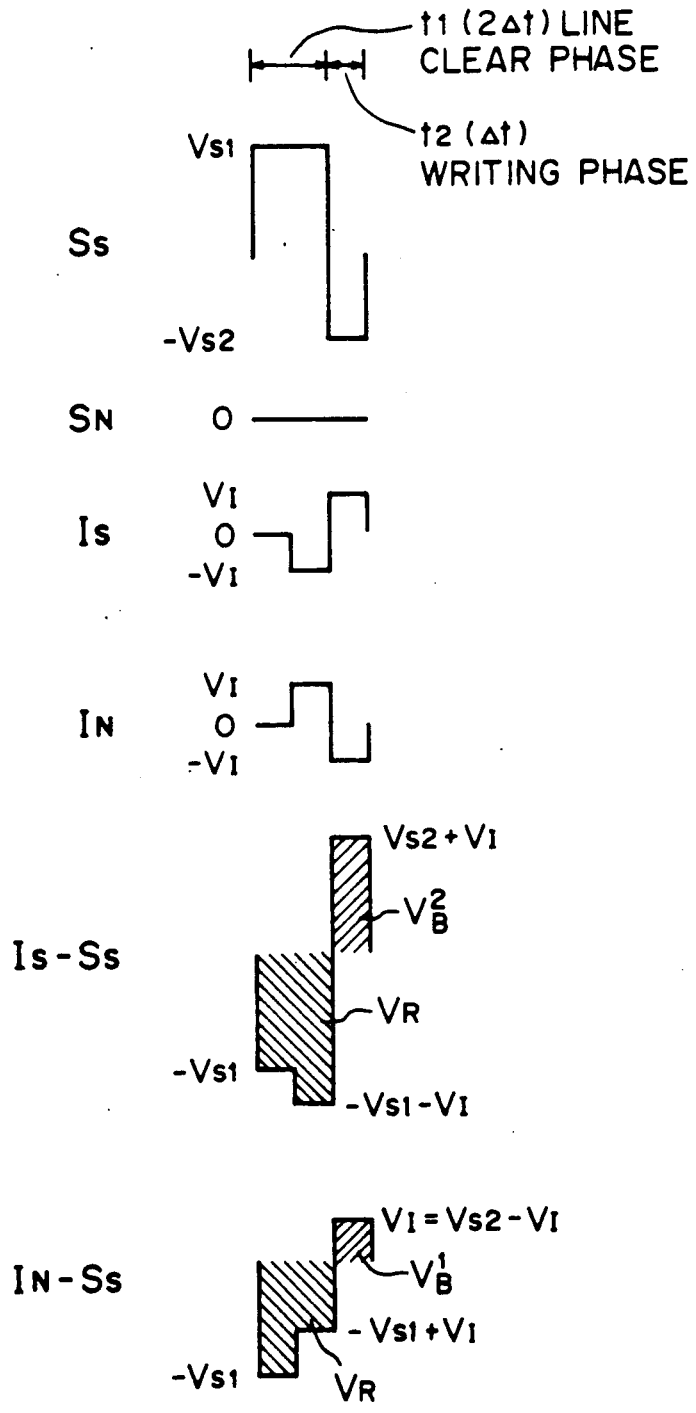
FIGS. 2,3A and 3B are waveform diagrams showing driving waveforms used in the invention.
Figure 3A:
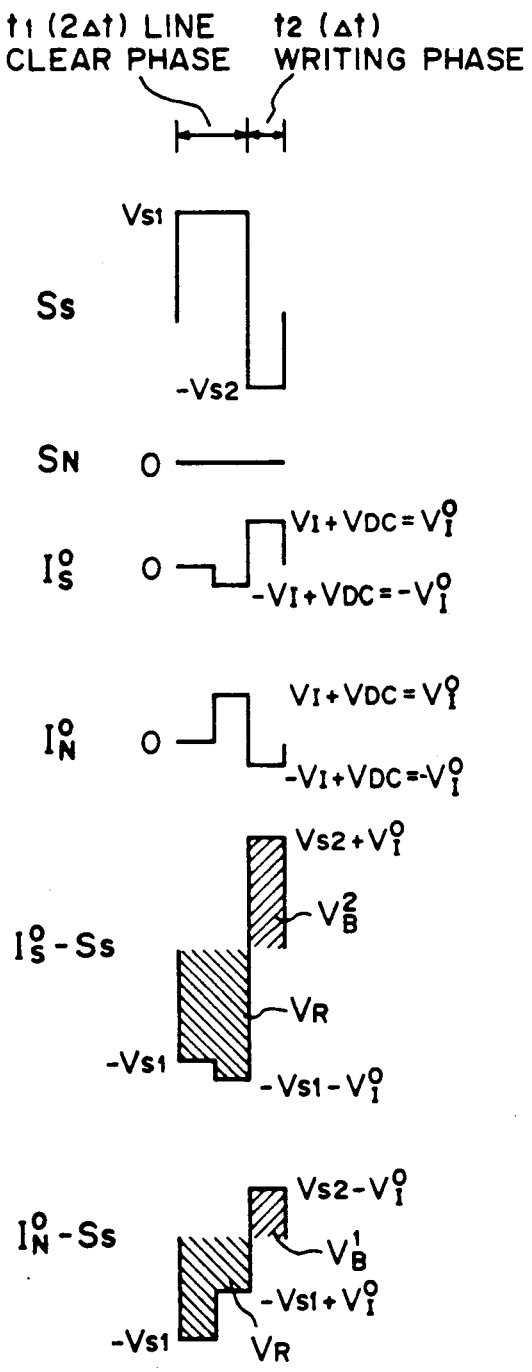
Figure 3B:
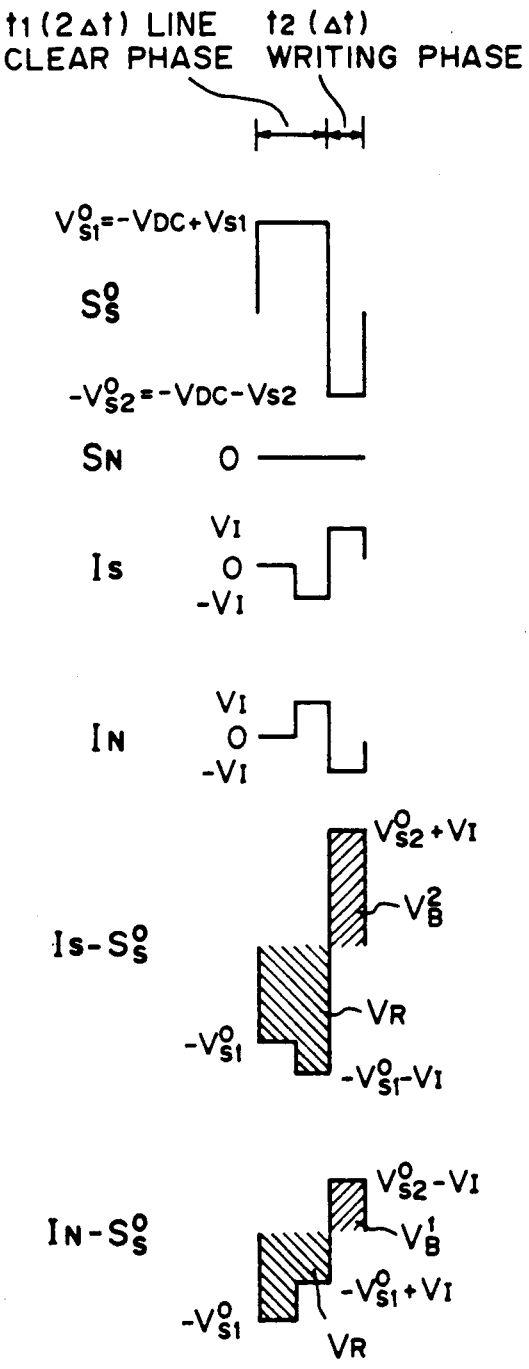

FIG. 1 is a block diagram for illustrating a liquid crystal apparatus according to the present invention. FIG. 2, 3A and 3B respectively show a set of driving waveforms used in the invention.

Referring to FIG. 1, the liquid crystal apparatus comprises an FLC (ferroelectric liquid crystal) panel 11, a scanning-side drive-circuit 12, a data-side drive circuit 13, and a power supply controller 14 which supplies a voltage of one polarity $V_{S1}$ and a voltage of the other polarity $V_{S2}$ for a scanning selection signal, and voltages $V_1$ and $V^0_I(=V_I+V_{DC}$, $V_{DC}$: DC voltage component) for data signals. The apparatus further comprises a temperature sensor 15 and a microprocessor unit 16.

In the apparatus shown in FIG. 1 when subjected to a refreshing drive of applying a scanning selection signal successively and repeatedly, the drive voltages ($V_{S1}$, $V_{S2}$, $V_I$ and $V^0_I$) and frame frequency may be selected by the microprocessor unit 16 depending on temperature data supplied from the temperature sensor 15 for each frame or field period, and they are set to the scanning-side drive circuit 12 and the data-side drive circuit 13 together with image data. The microprocessor unit 16 may also control the DC offset $V_{DC}$ in the data signal $V^0_I$ output from the data-side drive circuit 13 depending on the temperature data from the temperature sensor 15.

FIG. 2 shows a driving waveform embodiment wherein data signals with zero DC component are used, and FIG. 3A shows a driving waveform embodiment of using data signals superposed with a controlled DC component.

In FIG. 2 and FIG. 3A, respectively, at $S_S$ is shown a scanning selection signal; at $S_N$, a scanning nonselection signal; at $I_S$ or $I^0_S$ a selection data signal (black) applied to a selected data line; and at $I_N$ or $I^0_N$, a non-selection data signal (white) applied to a non-selected data line. Further, in the figures, at ($I_S$-$S_S$) or ($I^0_S$-$S_S$) and at ($I_N$-$S_S$) or ($I^0_N$-$S_S$) are shown voltage waveforms applied to pixels on a selected scanning line, among which the voltage ($I_S$-$S_S$) or ($I^0_S$-$S_S$) provides a pixel with a black display state, and the voltage ($I_N$-$S_S$) or ($I^0_N$-$S_S$) provides a pixel with a white display state.

In the embodiments shown in FIGS. 2 and 3A, the minimum application time $\Delta t$ of a voltage of a single polarity applied to the pixels on a selected scanning line corresponds to the duration of a writing phase $t_2$, and the duration of a one-line clearing phase $t_1$ is set to $2\Delta t$. In the present invention, it is generally possible to set the duration of the one-line clearing phase to a preferable value of $2\Delta t$ to $10\Delta t$ but it is most suited to set the period $2\Delta t$ as shown in the figures. Further, in the embodiments shown in FIGS. 2 and 3A, there is satisfied a relationship of $V^1_R < |Vsat|$, wherein $V^1_R$ denotes the maximum amplitude ($=|-V_S|$) of a voltage $V_R$ applied to a pixel ($I_N$-$S_S$) during the one-line clearing phase $t_1$ and the saturation threshold Vsat based on the minimum application time. It is further preferred that a relationship of $V^1_R \pm |Vth|$, particularly $\frac{1}{3} \cdot |Vsat| \leqq V^1_R \leqq |Vth|$, is satisfied, wherein Vth denotes the inversion threshold value based on the minimum application time $\Delta t$. Further, in the embodiments shown in FIGS. 2 and 3A, the maximum amplitude $|V_{S2}+V_1|$ of a voltage $V^2_B$ and the maximum amplitude of $V_{S1}$ in terms of absolute value are set to exceed the saturation threshold value Vsat based on the minimum application time $\Delta t$, and the maximum amplitude $|V_1|$ of the voltage $V^1_B$ is set to a value not exceeding the inversion threshold Vth.

In the embodiments shown in FIGS. 2 and 3A, the scanning selection signal applied to a selected scanning line comprises an alternating voltage having voltages set to $V_{S1}$ and $-V_{S2}$ (the voltage polarities being set with respect to the potential level of a non-selected scanning line), which are set to satisfy the relationship of $|V_{S1}|=3/2.|-V_{S2}|$. In the present invention, however, the values $V_{S1}$ and $V_{S2}$ may generally be set to $|V_{S1}| \geqq |-V_{S2}|$. As a result, in the present invention, the maximum amplitude $V^1_R$ of the voltage $V_R$ applied to a pixel ($I_N$-$S_S$) or ($I^0_N$-$S_S$) in the one-line clearing phase $t_1$ may be set to two or more times or three or more times, preferably two or three times, the maximum amplitude $|V_1|$ of the voltage $|V^1_B|$ applied in the writing phase $t_2$. Further, the maximum amplitude $V^2_R$ of the voltage $V_R$ applied to a pixel ($I_S$-$S_S$) or ($I^0_S$-$S_S$) in the one-line clearing phase may be set to a value equal to or larger than the maximum amplitude $|V_{S2}+V_2|$ of the voltage $V^2_B$ applied in the writing phase $t_2$. Further, in the present invention, the maximum amplitude of the voltage $V^2_B$ may be set to two or more times or three or more times, preferably two or three times, the maximum amplitude of the voltage $V^1_B$.

FIGS. 3A and 3B show data signals $I^0_S$ and $I^0_N$ which are given by superposing a DC component $V_{DC}$ (a DC component with respect to the voltage level of the scanning non-selection signal) on the data signals $I_S$ and $I_N$, respectively. The data signals $I^0_S$ and $I^0_N$ respectively assume an unbalanced or unsymmetrical alternating waveform through superposition of $V_{DC}$, and comprise voltage $\pm V^0_I$ including a DC component of the same polarity as that of the scanning selection signal at the one-line clearing phase $t_1$. The voltages $\pm V^0_I$ are set to a value smaller than the threshold voltage of the ferroelectric liquid crystal determined based on the writing phase period $t_2$. The polarity of the DC component $V_{DC}$ is not restricted to the one described above but can be a reverse one depending on the driving waveform.

FIG. 3B illustrates another embodiment of the invention. In this embodiment, the pixels on a scanning line are supplied with a DC component $V_{DC}$ through the scanning line in the one-line clearing phase $t_1$.

Figure 4A:
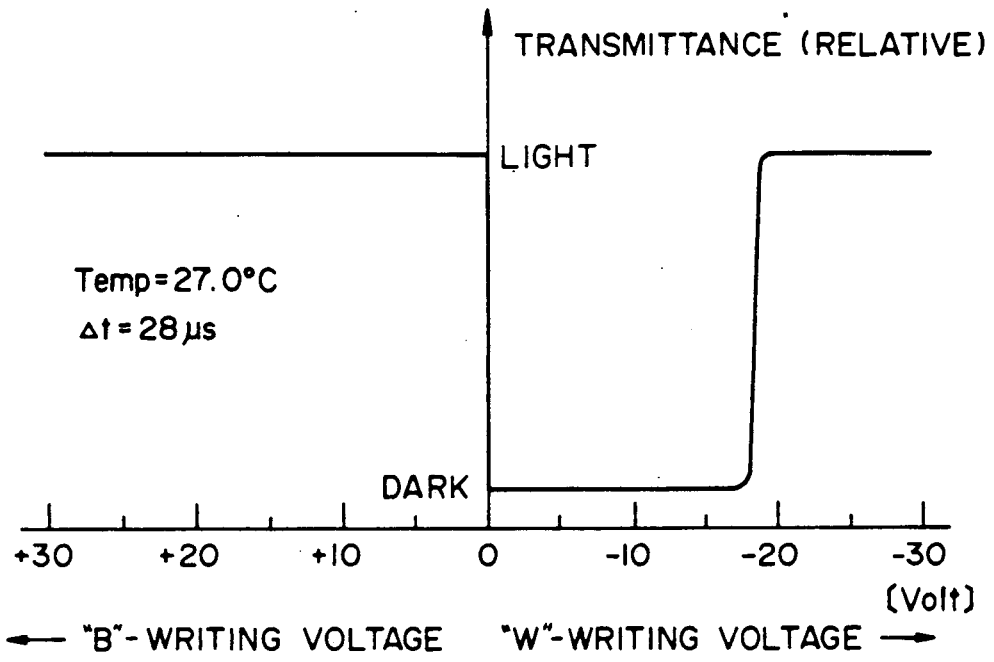
FIGS. 4A, 4B, 5A and 5B are diagrams showing electrooptical characteristics obtained by using the driving waveforms.

FIG. 4A shows electro-optical characteristics (V(applied voltage)/T(transmittance) characteristics) of a ferroelectric liquid crystal device shown in FIG. 10 when the device was supplied with driving waveforms explained with reference to FIG. 2. More specifically, FIG. 4A illustrates the transmittance of a pixel ($I_S$-$S_S$) at the time of white ("W")-writing due to applied voltage in the one-line clearing phase $t_1$ and the transmittance of the same pixel ($I_S$-$S_S$) at the time of black ("B")-writing at a temperature of 27° C. In FIG. 4A, the "W"-writing voltage on the right side represents the voltage $-V_{S1}$ in the waveform at $I^0_N$-$S_S$ in FIG. 2, and the "B"-writing voltage on the left side represents the voltage $V_{S2}+V^0_I$ at $I^0_S$-$S_S$ in FIG. 2.

FIG. 4A shows that the above-mentioned white ("W") writing operation was possible in the voltage range of ±30 V as a voltage applied to a pixel, but the black ("B")-writing operation was failed in the above voltage range.

Figure 4B:
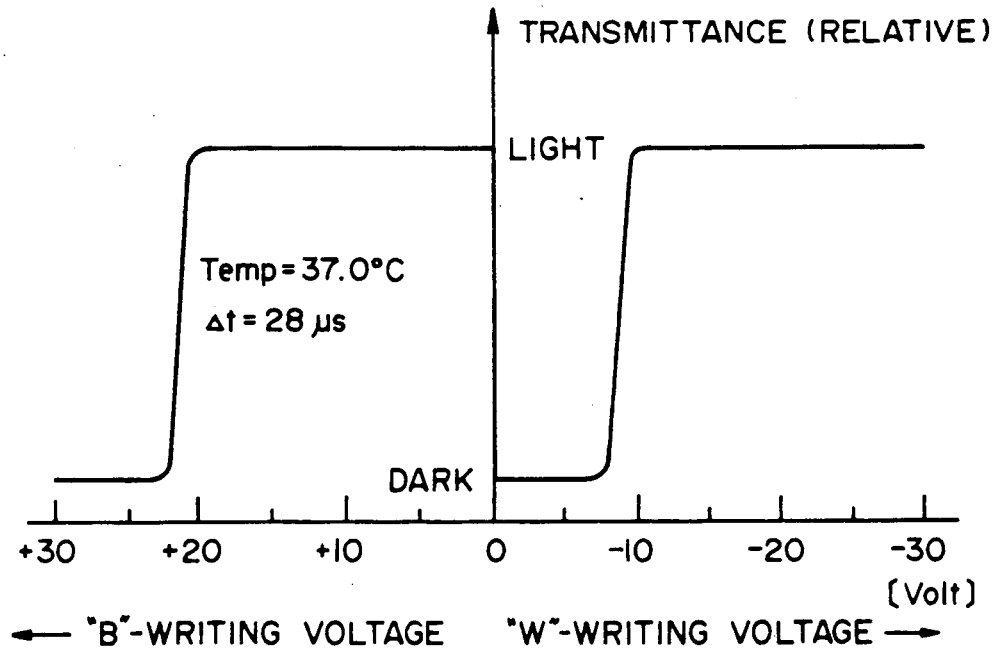

In contrast thereto, FIG. 4B shows electro-optical characteristics of the same device driven by the same application of the driving waveforms show in FIG. 2 except that the temperature was 37° C. FIG. 4B shows that the white writing operation and to black writing operation were both effected at a higher temperature in the pixel voltage range of ±30 V.

Figure 5A:
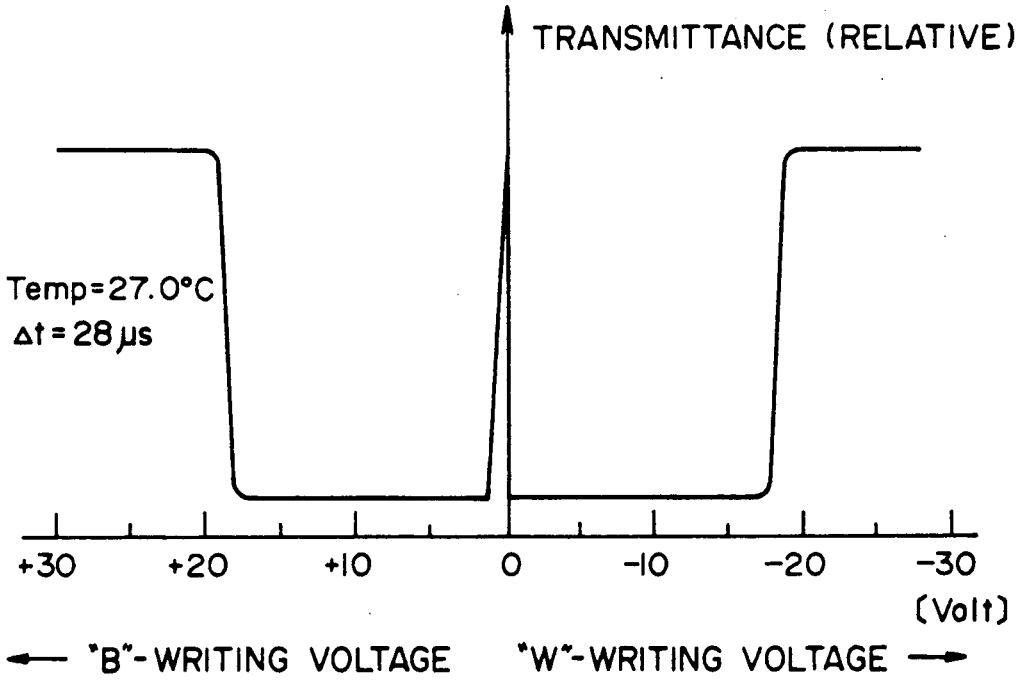

Further, FIG. 5A shows electro-optical characteristics obtained at a temperature of 27° C. by using driving waveforms shown in FIG. 3A wherein $V_{DC}=1.0$ V. In FIG. 5A, the "W"-writing voltage represents the voltage $-V_{S1}$ in the waveform at $I^0_N$-$S_S$, and the "B"-writing voltage represents the voltage $V_{S2}+V^0_I$ at $I^0_S$-$S_S$, respectively, in FIG. 3A. The electro-optical characteristics shown in FIG. 5A are different from those shown in FIG. 4A, and according to the characteristics, the white-writing operation and the black-writing operation can be effected in the pixel voltage range of ±30 V at a lower temperature range of 27° C. by superposing a DC component $V_{DC}$ of +1.0 V to provide unbalanced alternating data signals.

In the case of threshold characteristics shown in FIG. 5A, it is possible to effect writing by the combination of a writing voltage providing a high transmittance (white) on the left-side characteristic curve and a writing voltage providing a low transmittance (black) on the right-side characteristic curve in the Figure.

Figure 5B:
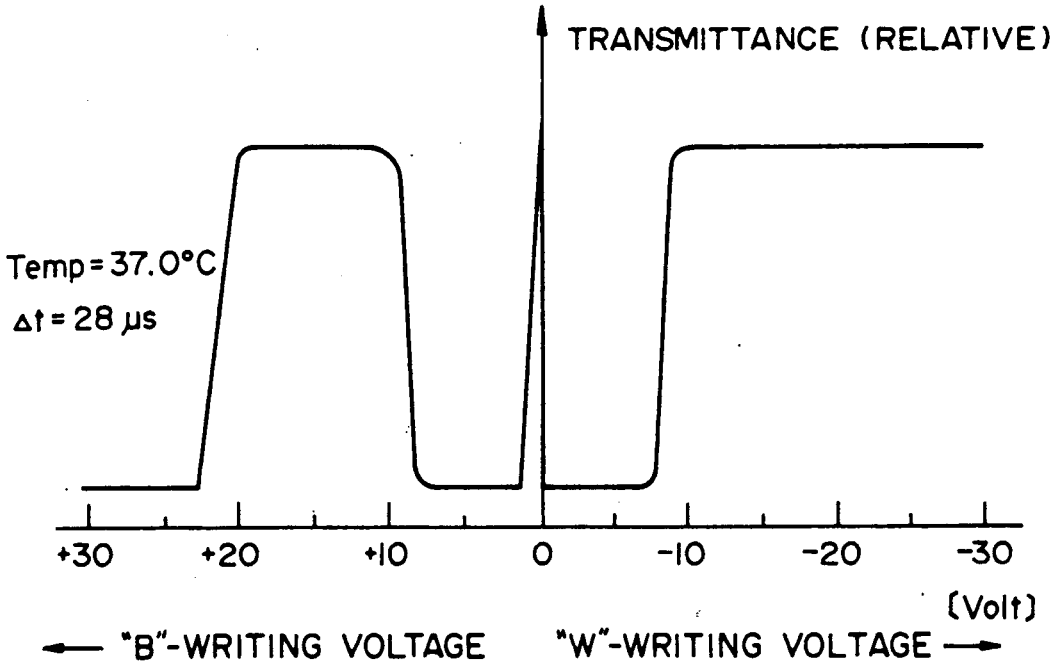

Further, FIG. 5B similarly as FIG. 5A shows electro-optical characteristics given under the same conditions except for a temperature of 37° C. by using the driving waveforms shown in FIG. 3A. According to the electro-optical characteristics shown in FIG. 5B different from those shown in FIG. 4, there results in a decrease in driving voltage margin at a higher temperature when the above-mentioned unbalanced alternating data signals are used.

Accordingly, in a preferred embodiment of the invention, the amount of DC offset $V_{DC}$ may suitably be set to a smaller value at a lower temperature in the operational temperature range of an FLC panel and to a larger value at a higher temperature. The DC offset $V_{DC}$ may for example be changed or switched stepwise or continuously depending on temperature increase (decrease).

Figure 6A:
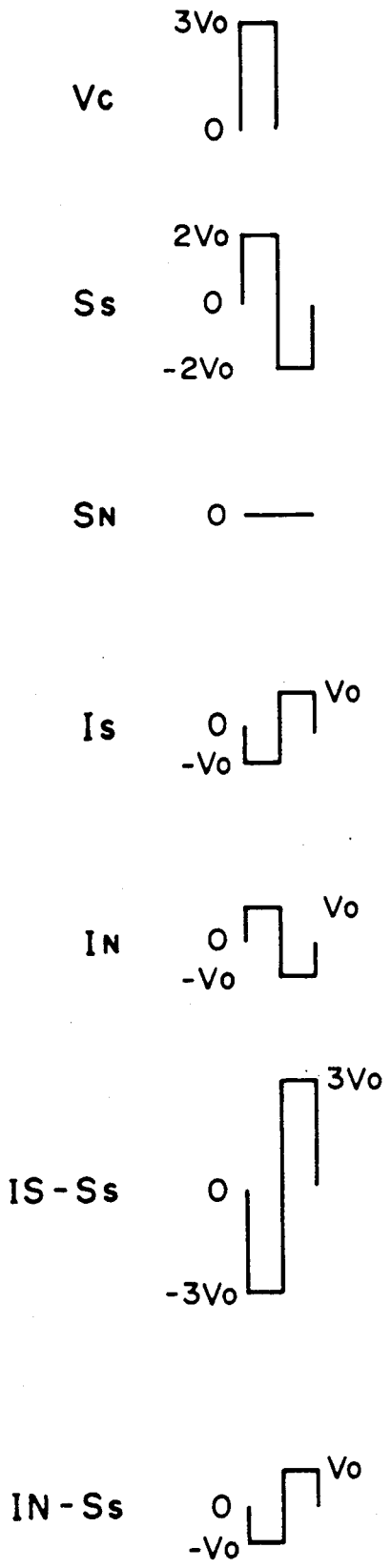
FIGS. 6A, 6B and 6C are diagrams showing another set of driving waveforms used in the invention.
Figure 6B:
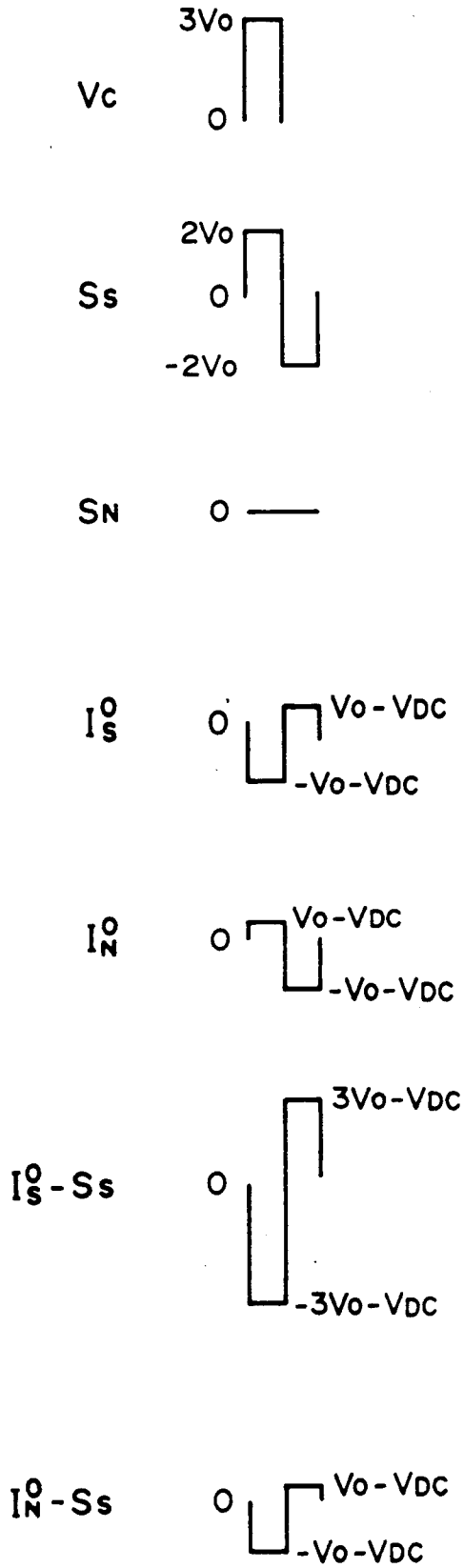
Figure 6C:
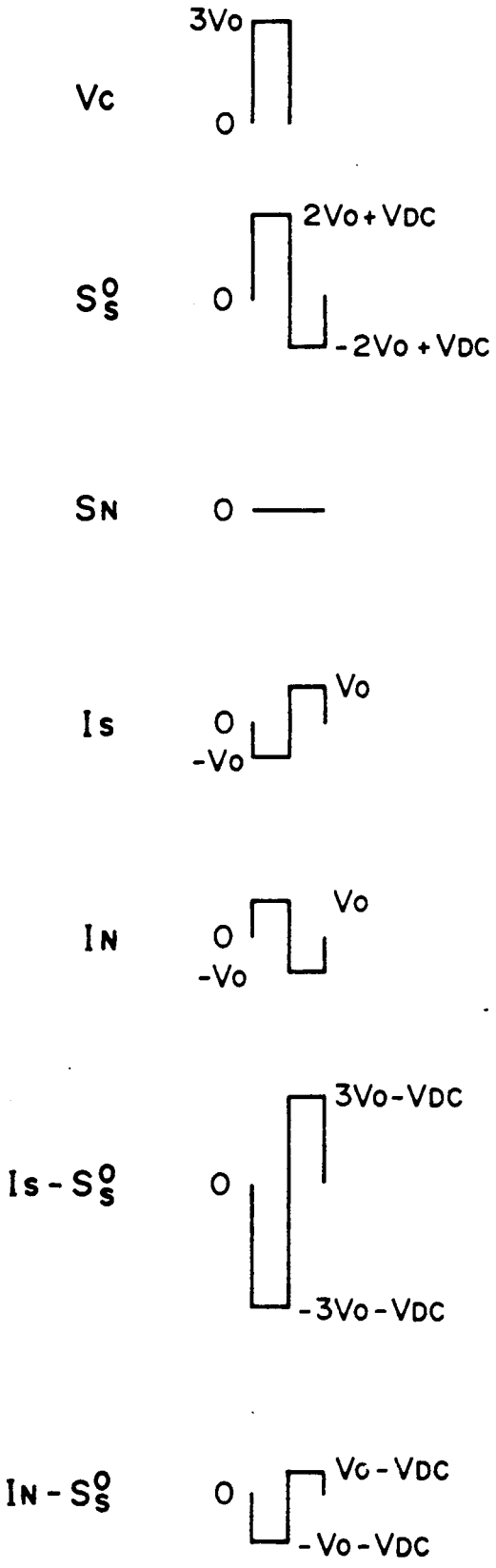

FIGS. 6A-6C show another preferred embodiment of driving waveform used in the invention. In FIGS. 6A-6C, a voltage $V_C$ is a voltage for simultaneously clearing all or a prescribed number of the pixels prior to writing and may for example be applied to the scanning electrodes simultaneously. A scanning selection signal $S_S$ comprises an alternating voltage having voltages $2V_0$ and $-2V_0$ and a scanning nonselection signal $S_N$ is set to a reference voltage 0. A data signal $I_S$ is a signal for inverting a cleared pixel, and a data signal $I_N$ is for maintaining a cleared pixel. These data signals are selectively applied to the data electrodes in phase with the scanning selection signal sequentially applied to the scanning electrodes. In the figures, signals $S^0_S$, $I^0_S$ and $I^0_N$ are signals obtained by superposing a DC component $V_{DC}$ on the above-mentioned signals $S_S$, $I_S$ and $I_N$, respectively, and comprise unbalanced alternating voltages. The DC component $V_{DC}$ may be set to provide a DC component $-V_{DC}$ having a polarity reverse to that of the voltage $V_C(=3V_0)$. It is possible to superpose the DC component $-V_{DC}$ on the data signal voltages or the scanning selection signal. In this instance, in the present invention, the DC component $V_{DC}$ may be varied from 0 to a prescribed offset value in the operational temperature range of an FLC panel. The polarity of the above mentioned DC component is not restricted to the above-mentioned one (minus of $-V_{DC}$) but can be the opposite The offset value for the DC component $V_{DC}$ can vary depending on a particular LC cell and on a driving waveform used but may suitably be in the range of ±0.001 V to ±2.0 V, preferably ±0.05 V to ±1.0 V.

Herein, the polarity (positive or negative) of a voltage signal is expressed with respect to the voltage level of a scanning non-selection signal as a standard.

In a preferred embodiment of the present invention, the above-mentioned driving waveforms are applied sequentially line by line of the scanning lines in a step (the period of which is taken as a one-frame or one-field period), and the step is cyclically and sequentially repeated to display a static picture or a motion picture.

Figure 7:
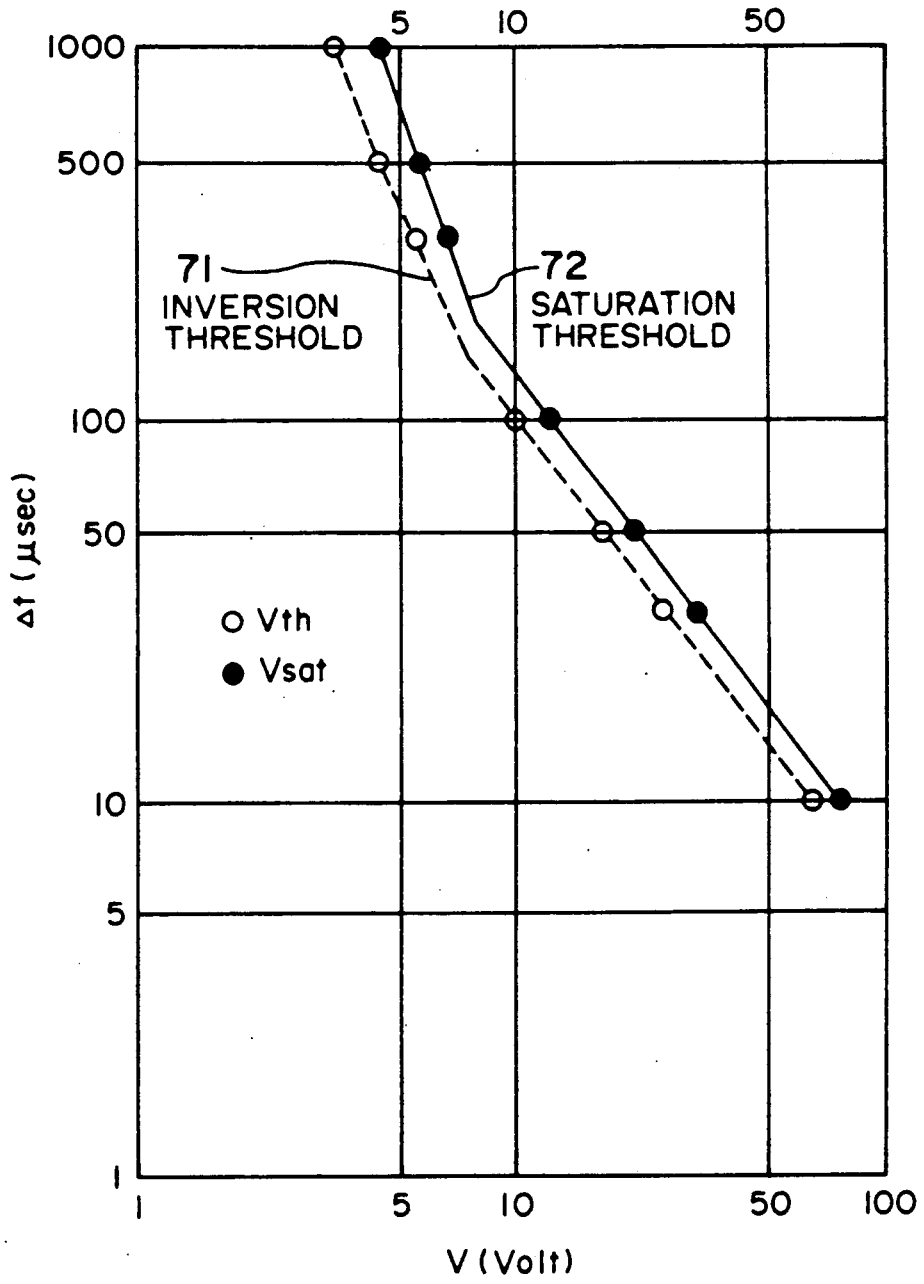
FIG. 7 is a characteristic view showing an applied voltage-application time correlation for inversion threshold and saturation threshold of an FLC (ferroelectric liquid crystal) pixel.

FIG. 7 is a characteristic diagram showing the dependence of the saturation threshold voltage Vsat and the inversion threshold voltage Vth on the voltage application time. More specifically, FIG. 7 shows a characteristic curve 71 of the inversion threshold voltage Vth and a characteristic curve 72 of the saturation threshold voltage Vsat.

Figure 8:
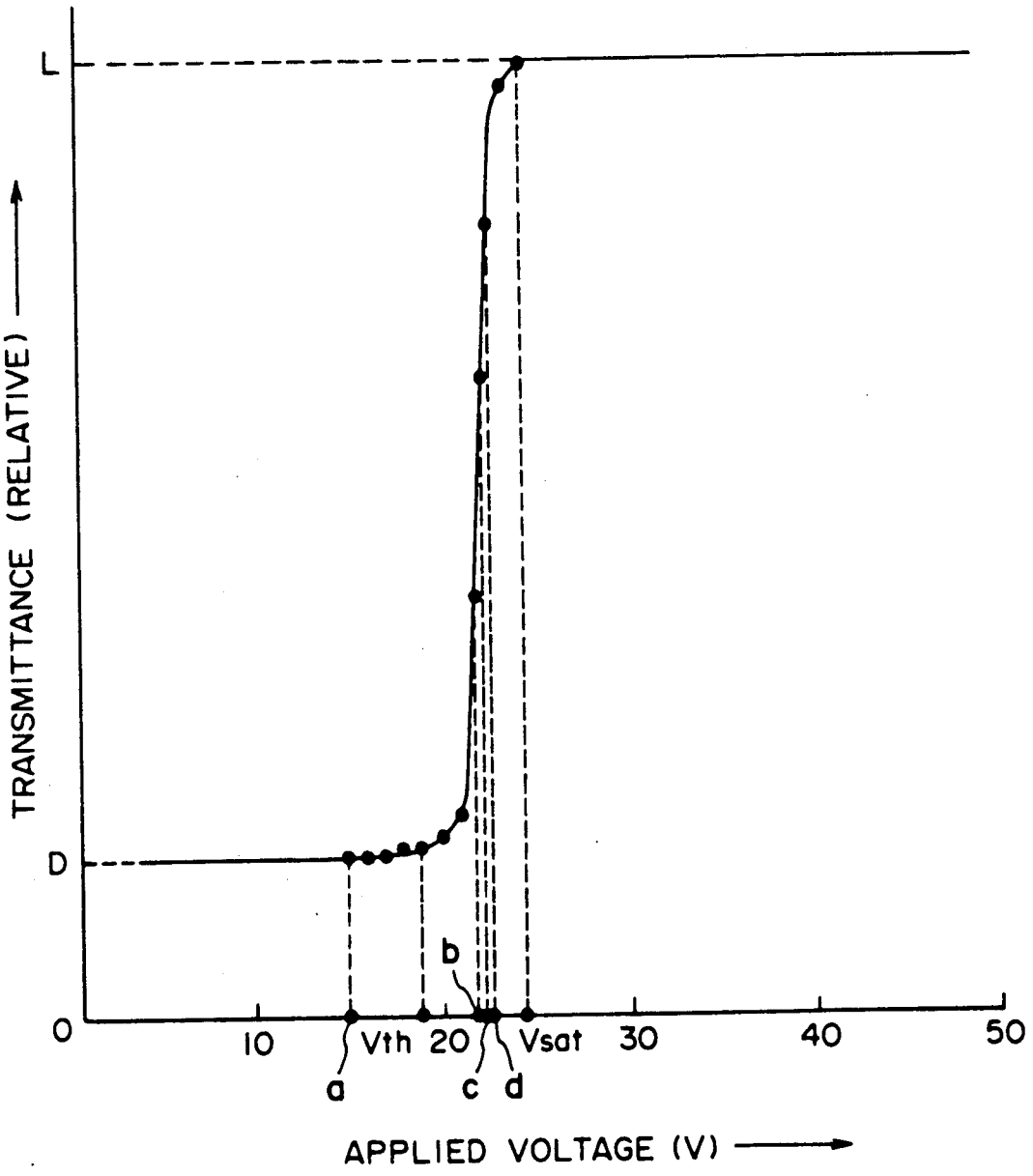
FIG. 8 is a characteristic view showing the change of transmittance versus the applied voltage of a pixel.
Figure 9A:
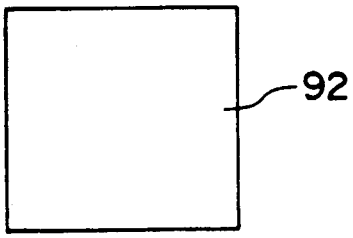
FIGS. 9A–9E are schematic views each illustrating an appearance of a cell.
Figure 9B:
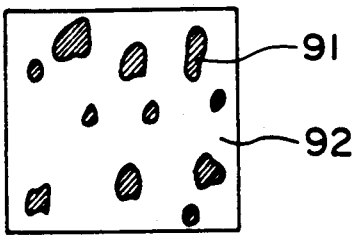
Figure 9C:
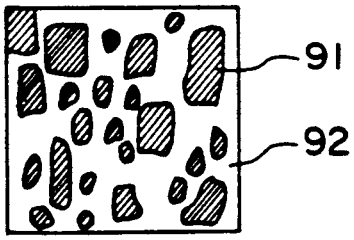
Figure 9D:
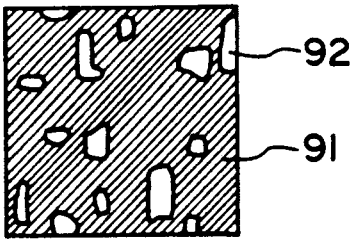
Figure 9E:
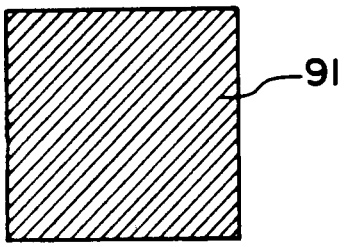

Incidentally, the "inversion threshold Vth" herein refers to a voltage at which an optical factor (transmittance or rate of shielding) of a pixel causes an abrupt change when the pixel is supplied with an increasing voltage capable of providing a pixel in one optical state with the other optical state and is shown as a voltage Vth in FIG. 8. On the other hand, the "saturation threshold Vsat" refers to a voltage at which the change of the optical factor in response to the increasing voltage is saturated and is shown as a voltage Vsat in FIG. 8. FIGS. 9A-9E illustrate a change in orientation state in a pixel in response to an increase in applied voltage. More specifically, FIG. 9A corresponds to a voltage a in FIG. 8; FIG. 9B to a voltage b in FIG. 8; FIG. 9C to a voltage c in FIG. 8; FIG. 9D to a voltage d in FIG. 8; and FIG. 9E to a voltage Vsat in FIG. 8. FIGS. 9A-9E show that the area of a black domain 91 which initially appears only partly in a white domain is increased relative to the area of the white domain 92 as the applied voltage is increased.

Figure 11:
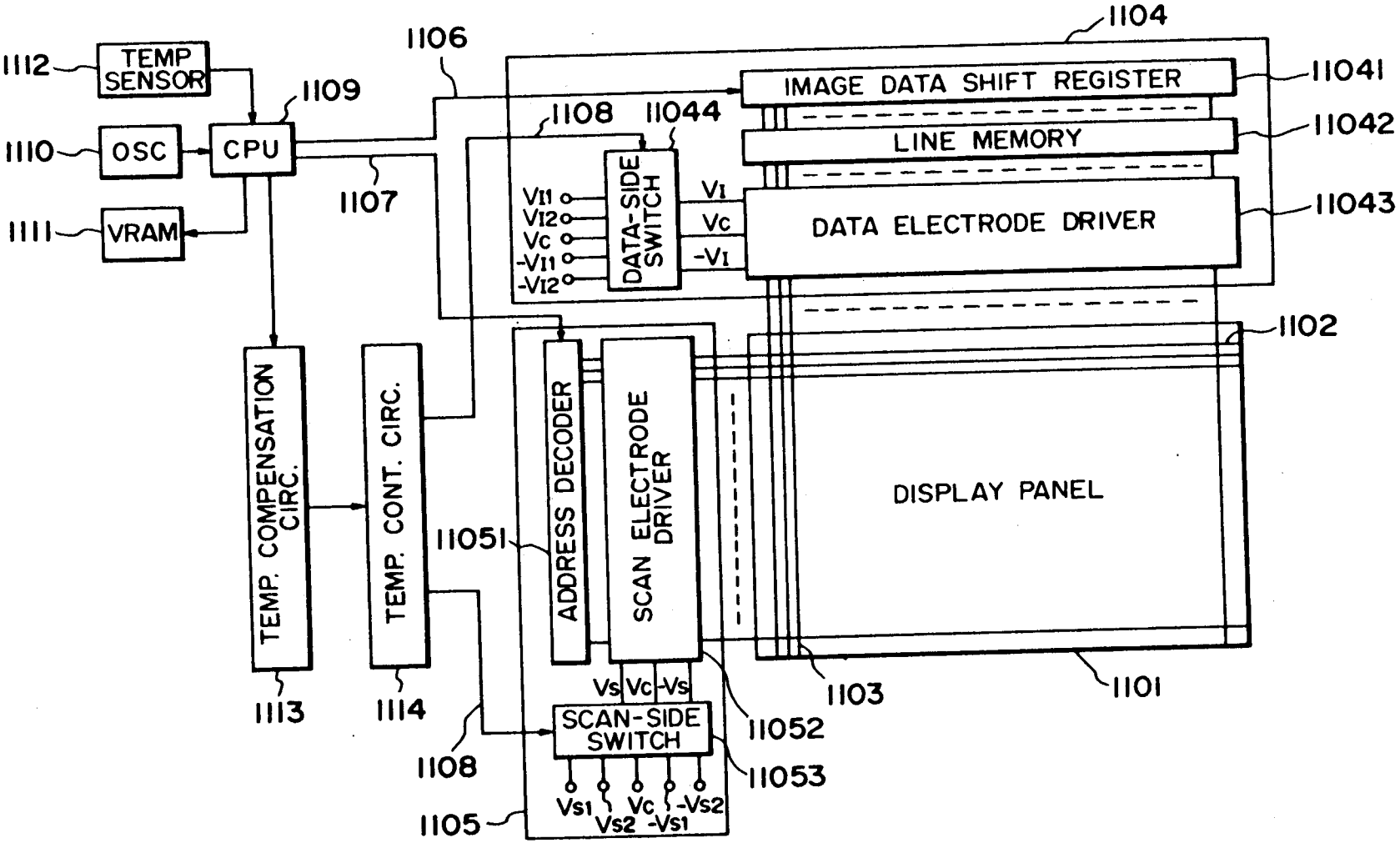
FIG. 11 is a block diagram for illustrating a liquid crystal apparatus according to the invention.

FIG. 11 is a block diagram for illustrating another embodiment of the display apparatus according to the invention. The display apparatus includes a display panel 1101 which in turn comprises scanning electrodes 1102, data electrodes 1103, and a ferroelectric liquid crystal disposed therebetween. At each of the matrix intersections formed by the scanning electrodes 1102 and the data electrodes 1103, the orientation of the ferroelectric liquid crystal is controlled by the direction of a voltage applied between the electrodes.

The data electrodes 1103 are connected to and driven by a data electrode driver circuit 1104 which comprises an image data shift register 11041 for storing image data serially supplied through a data signal line 1106, a line memory 11042 for storing image data supplied in parallel from the image data shift register 11041, a data electrode driver 11043 for supply voltages to the data electrodes 1103, and a data-side power supply changeover switch 11044 for switching among voltages $V_I$, $V_C$ and $-V_I$ supplied to the data electrodes 1103 according to signals from a changeover control line 1108.

The scanning electrodes 1102 are connected to and driven by a scanning electrode driver circuit 1105 which comprises an address decoder 11051 for addressing a scanning electrode among the scanning electrodes 1102 depending on signals from a scanning address data line 1107, a scanning electrode driver 11052 applying voltages to the scanning electrodes 1102 depending on signals from the decoder 11051, and a scanning-side power supply changeover switch 11053 for switching among voltages $V_S$, $V_C$ and $-V_S$ supplied to the scanning electrodes 1102 depending on signals from a changeover control line 1108.

A CPU 1109 receives clock pulses from an oscillator 1110 to control an image memory 1111 and control the transfer of signals to the data signal line 1106, the scanning address data line 1107, and the changeover control lines 1108.

Next, the operation of the apparatus constituted in the above-described manner will be described.

Figure 12:
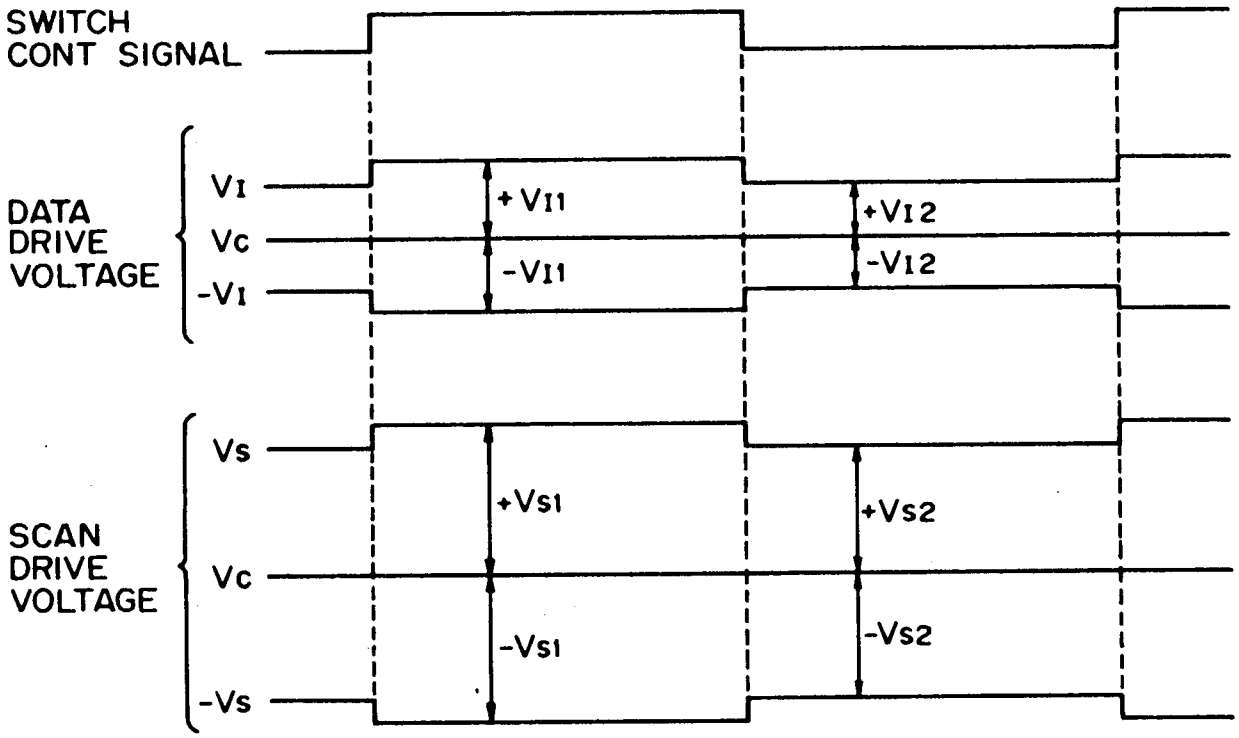
FIG. 12 is a time chart showing time correlation among switching control signal, data-side driving voltage and scanning-side driving voltage.

FIG. 12 is a time chart showing time correlation among the switching or changeover control signal from the changeover control line 1108, the data electrode driving voltages $V_I$, $V_C$ and $-V_I$, and the scanning electrode driving voltages $V_S$, $V_C$ and $-V_S$.

The switching of signals from the changeover control line 108 is effected in a period when the liquid crystal pixels are not supplied with an electric field, i.e., a vertical synchronizing period in refreshing drive in this embodiment. When the signal from the control line 1108 is at a high level, voltages of $+V_{I1}$ and $-V_{I1}$ are supplied as data electrode driving voltages, and voltages of $+V_{S1}$ and $-V_{S1}$ are supplied as scanning electrode driving voltages. Then, when the signal from the control line 1108 is at a low level, voltages of $+V_{I2}$ and $-V_{I2}$ are supplied as data electrode driving voltages and voltages of $+V_{S2}$ and $-V_{S2}$ are supplied as scanning electrode driving voltages. FIG. 12 shows a case satisfying the relationships of:

$$V_F+V_{I1}>+V_{I2},\ -V_F-V_{I1}>-V_{I2},$$

$$V_S+V_{S1}>+V_{S2},\ -V_S-V_{S1}>-V_{S2}.$$

Thus, at the high level of the signal from the change-over control line 1108, a higher voltage is supplied to a liquid crystal pixel than at the low level.

The apparatus shown in FIG. 11 is further provided with a temperature sensor 1112, a temperature compensation circuit 1113 and a temperature control circuit 1114. By means of these circuits, supply voltages of the scanning electrode driving circuit 1105 and the data electrode driving circuit 1104 may be controlled depending on the temperature.

Figure 13:
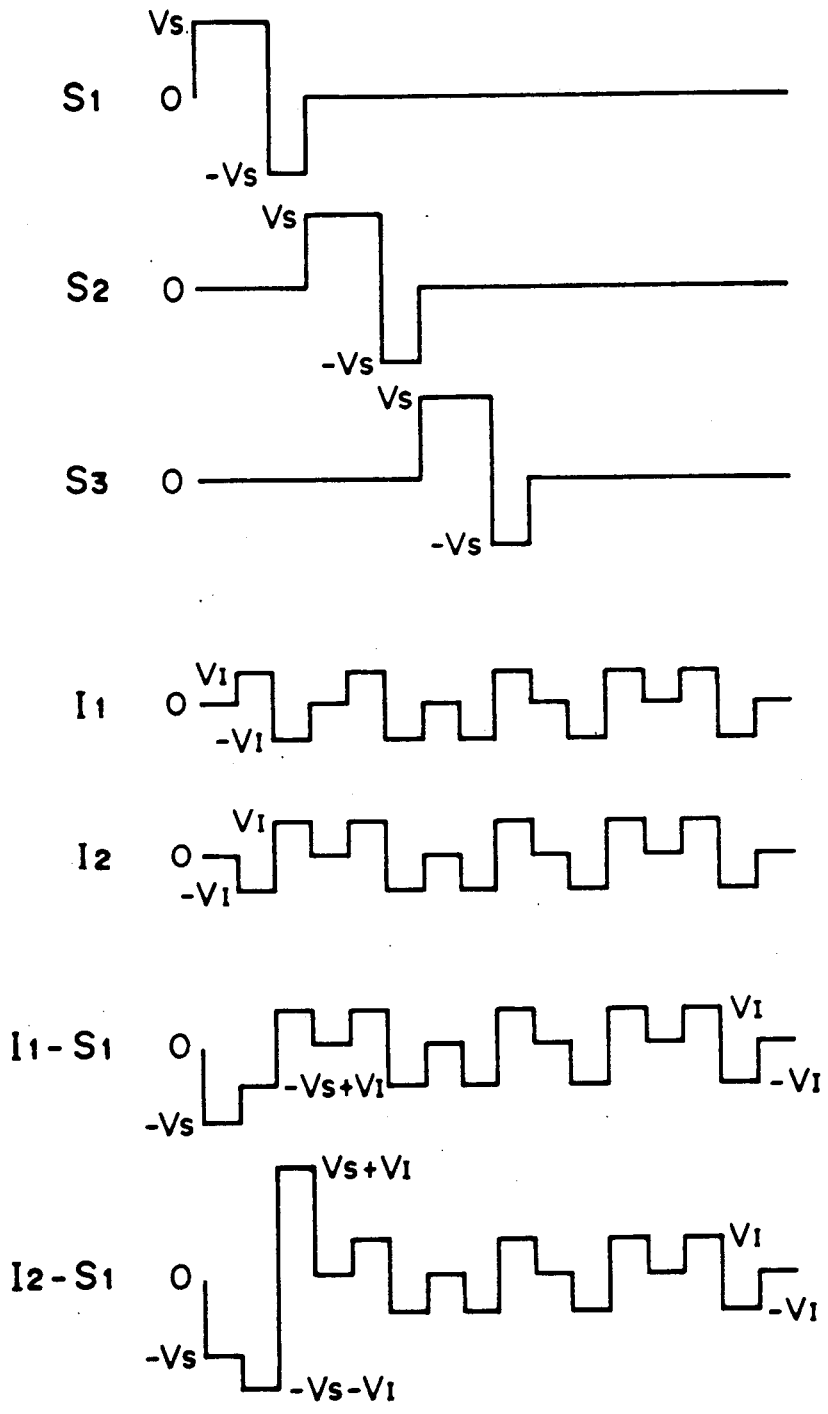
FIG. 13 is a time chart showing a time-serial continuation of driving voltages shown in FIG. 2.

The liquid crystal apparatus shown in FIG. 11 may be operated by using driving signal waveforms shown in FIG. 2. FIG. 13 is a time chart showing a continuation of the signal waveforms time-serially applied. Alternatively, a driving embodiment explained with reference to FIGS. 3A and 3B may be operated by using the apparatus.

FIG. 14A shows another set of driving wave-forms used in the invention. More specifically, FIG. 14A shows a scanning selection signal $S_{2n-1}$ (n=1, 2, 3 . . . ) applied to an odd-numbered scanning electrode and a scanning selection signal $S_{2n}$ applied to an even-numbered scanning electrode in both an odd-numbered frame $F_{2M-1}$ and an even-numbered frame $F_{2M}$. In FIG. 14A and subsequent similar figures, "W" denotes a white signal, "B" denotes a black signal, and "H" denotes a hold signal for retaining the previous state. According to FIG. 14A, the scanning selection signal $S_{2n-1}$ has mutually opposite voltage polarities (i.e., voltage polarities with respect to the voltage of the scanning non-selection signal) in the odd frame $F_{2M-1}$ and the even frame $F_{2M}$. This also holds true with the scanning selection signal $S_{2n}$. Further, the scanning selection signals $S_{2n-1}$ and $S_{2n}$ applied in one frame period have mutually different voltage waveforms and have mutually opposite voltage polarities in a single phase.

Further, in the driving embodiment shown in FIG. 4A, a third phase for having the whole picture pose (e.g., by applying a zero voltage to all the pixels constituting the picture) is provided and the third phase for each scanning selection signal is set to a zero voltage (the same voltage level as the scanning non-selection signal).

Further, in the embodiment of FIG. 14A, as for the data signals applied to data electrodes in the odd frame $F_{2M-1}$, a white signal ("W", providing a voltage $3V_0$ exceeding the threshold voltage of the ferroelectric liquid crystal at the second phase in combination with the scanning selection signal $S_{2n-1}$ to form a white pixel) and a hold signal ("H", providing a pixel with voltages $\pm V_0$ below the threshold voltage of the ferroelectric liquid crystal in combination with the scanning selection signal $S_{2n-1}$) are selectively applied in phase with the scanning signal $S_{2n-1}$; and a black signal ("B" providing a voltage $-3V_0$ exceeding the threshold voltage of the ferroelectric liquid crystal at the second phase in combination with the scanning selection signal $S_{2n}$ to form a black pixel) and a hold signal ("H", providing a pixel with voltages $\pm V_0$ below the threshold voltage of the ferroelectric liquid crystal) are selectively applied in phase with the scanning selection signal $S_{2n}$.

In the even frame $F_{2M}$ subsequent to writing in the above-mentioned odd frame $F_{2M-1}$, the above-mentioned black signal ("B") and hold signal ("H") are selectively applied in phase with the scanning selection signal $S_{2n-1}$, and the above mentioned white signal ("W") and hold signal ("H") are selectively applied in phase with the scanning selection signal $S_{2n}$.

FIGS. 14B, 14C and 14D show a set of driving waveforms obtained by superposing $\pm V_{DC}$ on the voltage $+V_0$ of the data signals, a set of driving waveform obtained by superposing $\pm V_{DC}$ on the voltages $+2V_0$ of the scanning selection signals, and a set of driving waveforms obtained by superposing $\pm V_{DC}$ on the voltages $\pm V_0$ of the data signals, respectively, in the set of driving waveforms shown in FIG. 14A.

FIGS. 15A–15D and FIGS. 16A–16D respectively show another set of driving waveforms used in the invention. FIGS. 15A and 16A respectively show a set of driving waveforms wherein two types of scanning selection signal $S_n$ having mutually opposite polarities in a particular phase are alternately applied in an odd frame and an even frame, respectively. FIGS. 15B, 15C and 15D and FIGS. 16B, 16C and 16D respectively show sets of driving waveforms obtained by superposing $\pm V_{DC}$ on the voltage $+V_0$ of the data signals, $\pm V_{DC}$ on the voltage $\pm 2V_0$ of the scanning selection signals and $\pm V_{DC}$ on the voltages $\pm V_0$ of the data signals, respectively, in the sets of driving waveforms shown in FIGS. 15A and 16A, respectively.

Figure 17:
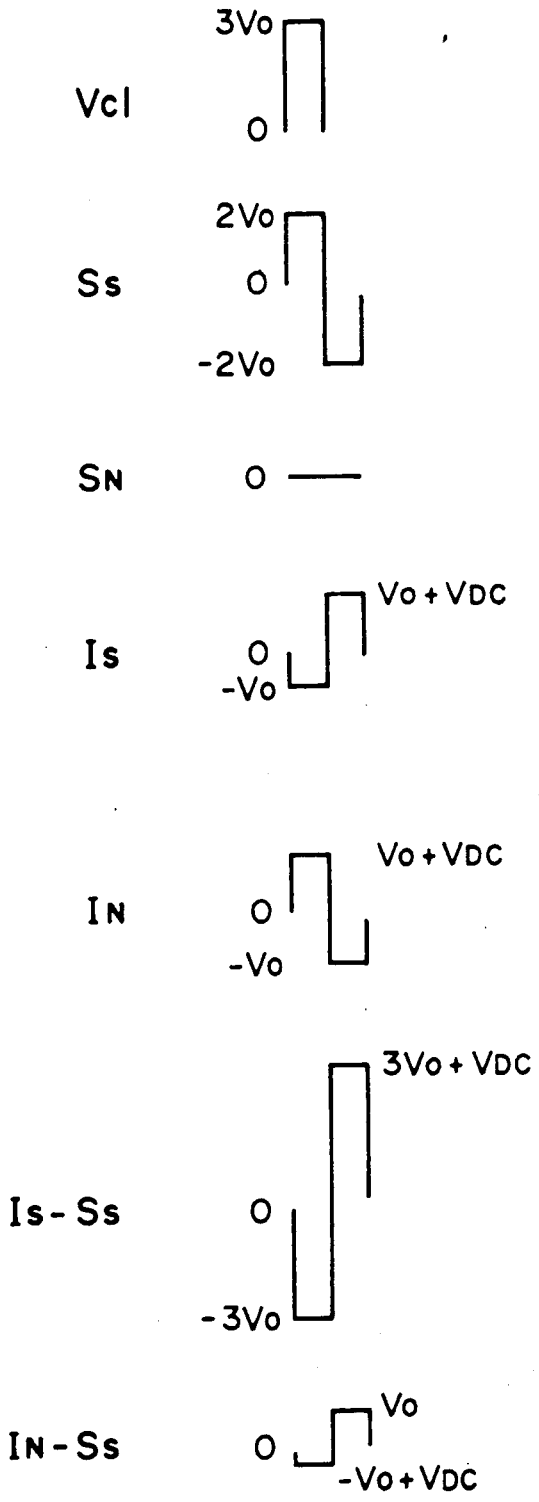
FIG. 17 shows another set of driving voltage waveforms used in the invention.

FIG. 17 shows another preferred set of driving waveforms used in the invention. In FIG. 17, a voltage $V_{cl}$ is a voltage for simultaneously clearing all or a prescribed number of the pixels prior to writing and may be simultaneously applied to the scanning electrodes, for example. A scanning selection signal $S_S$ comprises an alternating voltage with voltages $2V_0$ and $-2V_0$, and a scanning non-selection signal $S_N$ is set to a reference voltage of zero. A data signal $I_S$ is applied for inverting a cleared pixel, and a data signal $I_N$ is applied for holding a cleared pixel. These data signals are selectively applied to the data electrodes in synchronism with the scanning selection signal sequentially applied to the scanning electrodes.

The above-mentioned data signals $I_S$ and $I_N$ are respectively superposed with a DC component $V_{DC}$ to form unbalanced or unsymmetrical alternating voltages. The DC component $V_{DC}$ may have the same polarity as the voltage $V_{cl}$ ($3V_0$) It is also possible that the DC component $V_{DC}$ is superposed on the data signal voltage ($+V_0$) having the same polarity. In this instance, in the present invention, the DC component $V_{DC}$ may be varied in the range of from zero to a prescribed offset value in the operational temperature range of an FLC panel. The polarity of the DC component $V_{DC}$ is not restricted to the one described above but can be reverse.

In a specific case, all the pixels formed with the matrix electrode shown in FIG. 10 were driven by a ¼ bias method using the set of driving waveforms shown in FIG. 2 (FIG. 13) at temperatures of 15° C., 25° C. and 35° C., respectively, whereby the contrasts of the pixels were measured. In this instance, a chiral smectic ferroelectric liquid crystal comprising an ester-type mixture liquid crystal and showing the following phase transition series was used:

$$\text{Iso.} \xleftarrow[67.3^\circ\text{ C.}]{} \text{Ch} \xleftarrow[63.1^\circ\text{ C.}]{} \text{SmA} \xleftarrow[47.7^\circ\text{ C.}]{} \text{SmC*} \xleftarrow[-5.0^\circ\text{ C.}]{} \text{Cry.}$$

wherein Iso denotes isotropic phase; Ch, cholesteric phase; SmA, smectic A phase; SmC*, chiral smectic phase; and Cry., crystal phase. The minimum phase duration $\Delta t$ was set to 28 μsec. The driving voltage amplitudes were set to optimum values at the respective temperatures and were superposed with DC bias voltages for driving. The contrasts were calculated as a ratio between the transmittances obtained when an all white pattern and an all black pattern were displayed respectively. The results of the measurement are summarized in FIG. 18, wherein the ordinate represents contrast and the abscissa represents temperatures.

Figure 18:
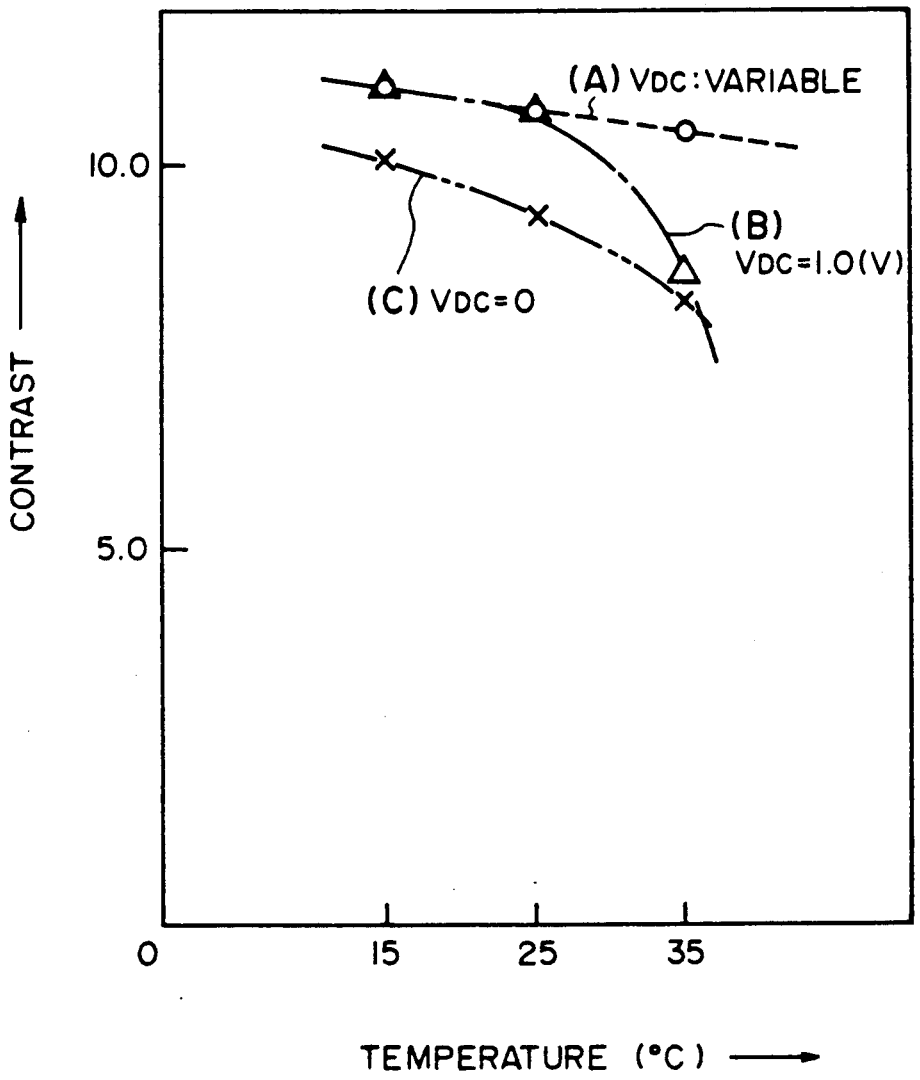
FIG. 18 is a characteristic view showing a temperature dependence of contrast.

In FIG. 18, the curve (A) represents the results obtained by changing the magnitude of $V_{DC}$ so as to obtain maximum contrasts at the respective temperatures, and the curve (B) represents the results obtained in the case where $V_{DC}$ was fixed at a value ($V_{DC}=1.0$ V) providing a maximum contrast at 25° C.

As shown in FIG. 18, the curve (B) gives a remarkably decreased contrast at 35° C., whereas the curve (A) obtained by using optimum $V_{DC}$ values (1.0 V at 15° C., 1.0 V at 25° C. and 0.5 V at 35° C.) at the respective temperatures gives high contrasts at all the temperatures. On the other hand, the curve (C) in FIG. 18 represents the results obtained in the absence of DC bias ($V_{DC}=0$). According to the temperature compensation driving method of the invention, a high contrast was maintained at a high temperature where cross-talk was liable to occur and contrast irregularity over the whole picture was decreased at a low temperature, whereby a high quality display was realized over the whole temperature range for use.

In the present invention, it is suitable to set the change in amplitude of driving voltage at the time of amplitude change to ±0.5% to ±10.0%, preferably ±1.0% to ±5.0% of the driving voltage amplitude in one frame (or one field).

Figure 19:
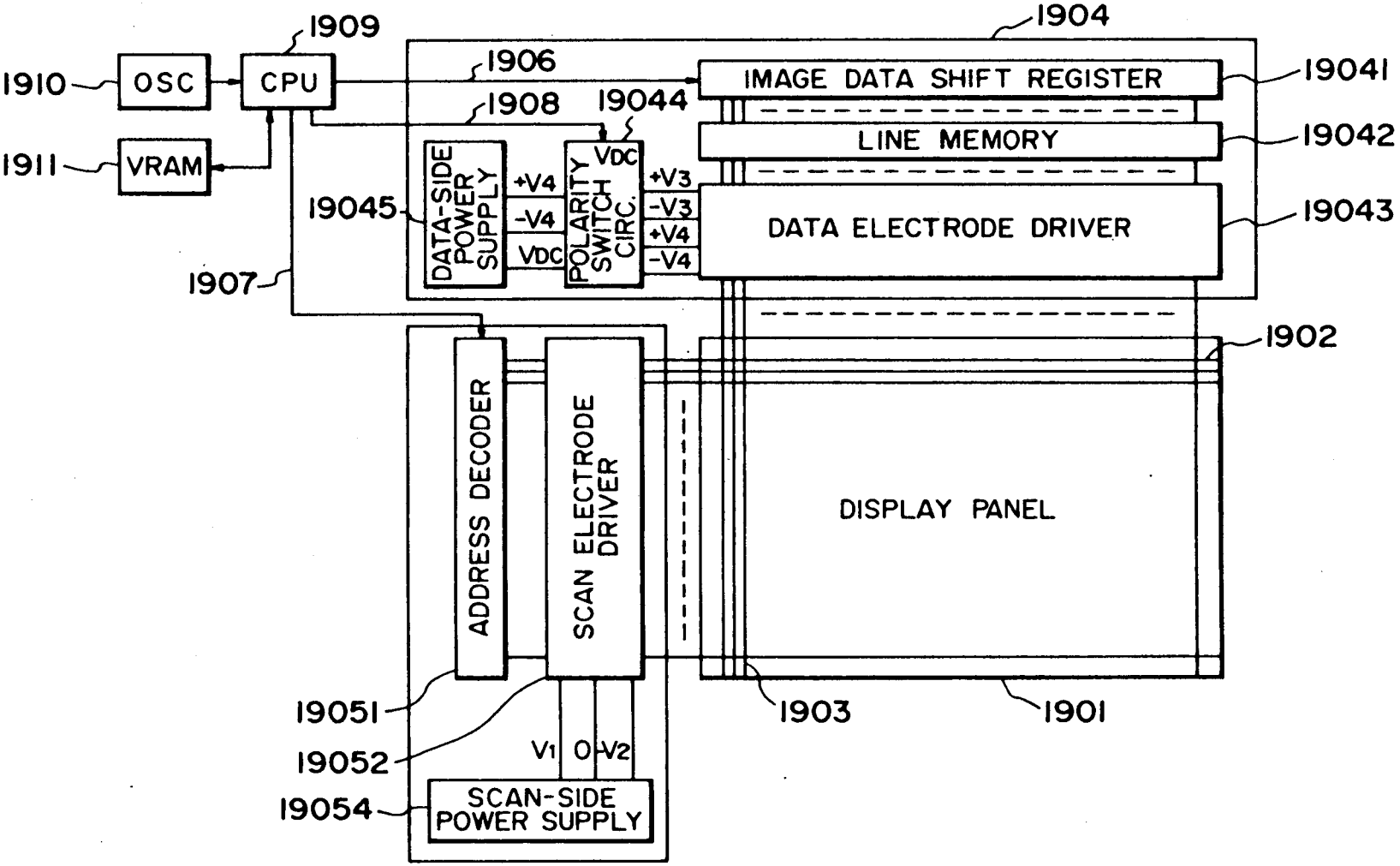
FIG. 19 is a block diagram of another liquid crystal apparatus according to the invention.

FIG. 19 is a block diagram for illustrating still another embodiment of the display apparatus according to the invention. The display apparatus includes a display panel 1901 which in turn comprises scanning electrodes 1902, data electrodes 1903, and a ferroelectric liquid crystal disposed therebetween. At each of the matrix intersections formed by the scanning electrodes 1902 and the data electrodes 1903, the orientation of the ferroelectric liquid crystal is controlled by the direction of a voltage applied between the electrodes.

The data electrodes 1903 are connected to and driven by a data electrode driver circuit 1904 which comprises an image data shift register 19041 for storing image data serially supplied through a data signal line 1906, a line memory 19042 for storing image data supplied in parallel from the image data shift register 19041, a data electrode driver 19043 for supplying voltages to the data electrodes 1903, and a $V_{DC}$ polarity change-over switch 19044 for switching the polarity of a DC offset voltage $V_{DC}$ superposed on an alternating voltage comprising voltages $V_4$ and $-V_4$ supplied to the data electrodes 1903 according to signals from a change-over control line 1908.

The scanning electrodes 1902 are connected to and driven by a scanning electrode driver circuit 1905 which comprises an address decoder 19051 for addressing a scanning electrode among the scanning electrodes 1902 depending on signals from a scanning address data line 1907, a scanning electrode driver 19052 applying voltages to the scanning electrodes 1902 depending on signals from the decoder 19051, and a scanning-side power supply 19054 for supplying voltages $V_1$, $-V_2$ and 0 to the scanning electrodes 1902.

A CPU 1909 receives clock pulses from an oscillator 1910 to control an image memory 1911 and control the transfer of signals to the data signal line 1906, the scanning address data line 1907, and the change-over control line 1908.

According to our experiments, it has been found that a so-called "panel cross-talk" is liable to occur especially when a driving method using a short period for selecting one scanning line is applied, but the cross-talk can be alleviated by superposing a constant DC component on an AC driving pulse.

Hereinbelow, the above-mentioned "panel cross-talk" and the effect of superposition of a DC component are explained in more detail with reference to an embodiment using a set of driving waveforms shown in FIG. 20.

Figure 20:
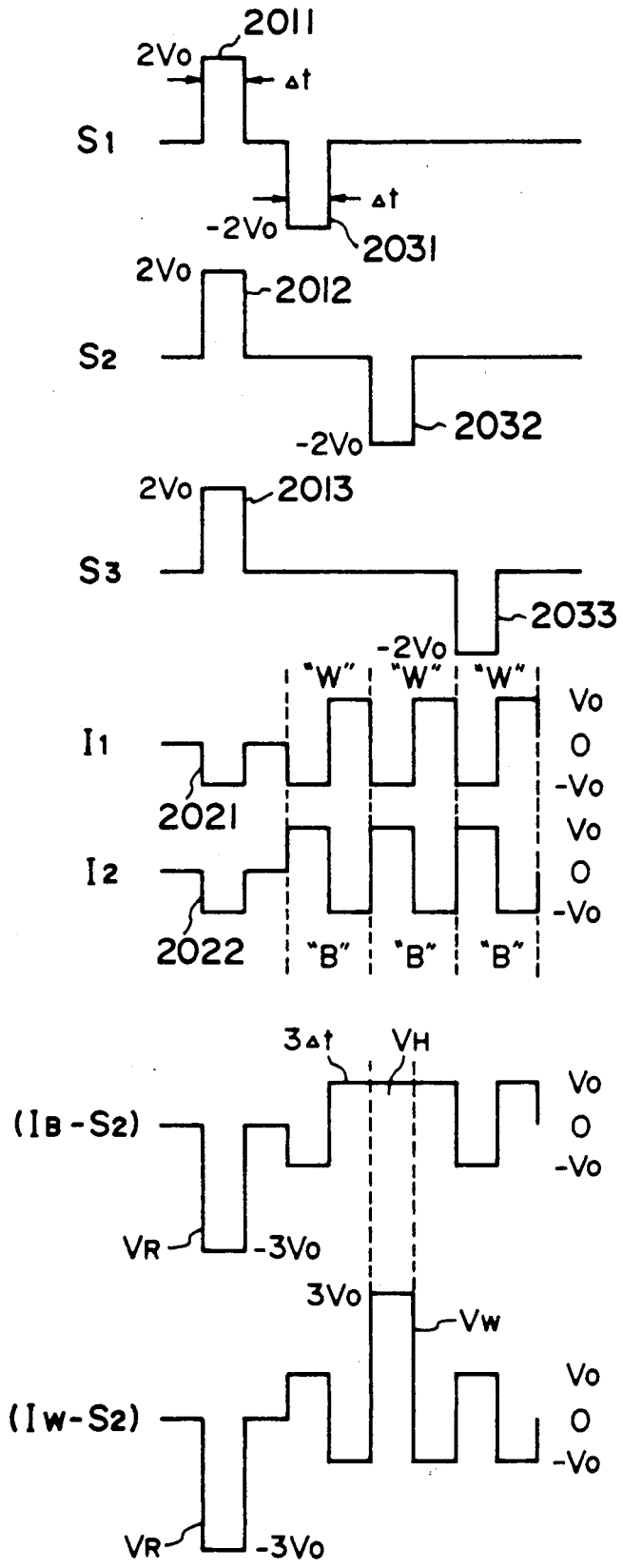
FIG. 20 is a waveform diagram showing a driving example outside the invention.

Referring to FIG. 20, at $S_1$, $S_2$, $S_3$, . . . are shown voltages time-serially applied to a first scanning line, a second scanning line, a third scanning line, . . . , respectively, and at $I_1$ and $I_2$ are shown voltages time-serially applied to data lines $I_1$ and $I_2$, respectively. In this instance, the signal applied to the data line $I_1$ data signals of white-white-white ("W"-"W"-"W") and the signal applied to the data line $I_2$ includes data signals of black-black-black ("B"-"B"-"B"). In the erasure or clearing step, the scanning lines are simultaneously and uniformly supplied with phase voltages 2011, 2012, 2013, . . . each having a pulse duration of $\Delta t$, and simultaneously therewith, the data lines are uniformly supplied with voltages 2021, 2022 each having a pulse duration of $\Delta t$. As a result, the respective intersections are uniformly supplied with a voltage $V_R$ exceeding the threshold voltage on one side of the ferroelectric liquid crystal, so that the whole picture is erased into white (or black). In the subsequent writing step, the scanning lines are sequentially supplied with voltages 2031, 2032, 2033, . . . each constituting a scanning selection signal. In phase with the scanning selection signal, the data lines are selectively supplied with a white (or black) signal comprising an AC voltage of $-V_0$ and $+V_0$, and a black (or white) signal comprising an AC voltage of $+V_0$ and $-V_0$ As a result, a pixel at an intersection supplied with the black signal receives a voltage $V_W$ exceeding the threshold voltage on the other side of the ferroelectric liquid crystal to provide a black (or white) display, and a pixel at an intersection supplied with the white signal receives a voltage $V_H$ not exceeding the threshold voltage of the ferroelectric liquid crystal (based on the pulse duration $\Delta t$) to retain the display state of white (or black) obtained in the erasure step as it is.

In this instance, if the duration of a unit pulse having the smallest duration among the unit pulses constituting the driving signals (scanning selection signal and data signal) is denoted by $\Delta t$, the period for selecting one scanning line in this embodiment is 2Δt except for the erasure step.

Now, a pixel on a second scanning line is noted as shown at ($I_1$-$S_2$) in FIG. 20. The pixel can receive a pulse with a low voltage but a long duration (3Δt in this case) in a direction opposite to the erasure pulse $V_R$ as shown depending on image data at the time of half-selection. Herein, the occurrence of a pulse of a particular (one and the same) polarity having a duration of nΔt which is n times the unit duration Δt is referred to as "n·Δt crosstalk". It is of course necessary that the parameters (frequency, peak value) of driving pulses are set so that switchinq is caused by a writing pulse $V_W$ and not by nΔt crosstalk in connection with the switching threshold characteristic determined by the pulse duration and peak value. In other words, it is necessary that there is a driving margin providing driving conditions under which switching is caused by a writing pulse $V_W$ and not by n·Δt crosstalk. It is however difficult to control the cell conditions, such as the cell thickness and liquid crystal molecule alignment states over the whole cell area in case of a ferroelectric liquid crystal cell of a large area. As a result, it is difficult at present to uniformly set the above-mentioned driving margin over the entire cell. Such fluctuation of driving margin in a cell is liable to result in noticeable image irregularity in a driving method using a short period for selecting one scanning line as described above, which has a small driving margin by nature. The term "panel crosstalk" is used herein to generally refer to phenomena that such nΔt crosstalk in a driving waveform leads to failure in prevention of local irregular switching because of ununiformity of a liquid crystal cell and failure of driving margin, thus resulting in image irregularities, such as occurrence of a pixel giving a display state different from given data or a pixel presenting an intermediate color because of generation of a polarized domain in the pixel.

Now, a negative (⊖) DC component is superposed on the driving waveforms shown in FIG. 20. The liquid crystal cell itself is provided with symmetrical alignment treatment on both substrates and is bistable at least at the initial state, so that the above-mentioned panel crosstalk can be considerably alleviated to provide a good image on the whole picture by superposing such a DC component on an AC driving pulse applied to pixels. The exact mechanism of the effect of DC component application has not been clarified as yet, but it is assumed that the DC component alleviates the above-mentioned n·Δt crosstalk appearing in a driving waveform, so that the driving margin is enlarged to alleviate the panel crosstalk It is however extremely difficult to maintain the effect of the DC component application for a long period, and a panel crosstalk occurs again with elapse of time. This has been found through our experiments. The detailed reason for this decrease in effect of the DC component application with elapse of time is not clear again, but a possible reason may be that a DC component applied to the liquid crystal layer disappears with elapse of time or the DC component causes a change in bistability of the liquid crystal molecules Anyway, it is not desirable to continually apply a DC component of a particular polarity.

According to our further experiments, however, the above problems have been substantially solved by inverting the polarity of the DC component in a certain cycle, e.g., a cycle of one frame (or one field) or one scanning line-selection period.

Figure 21A:
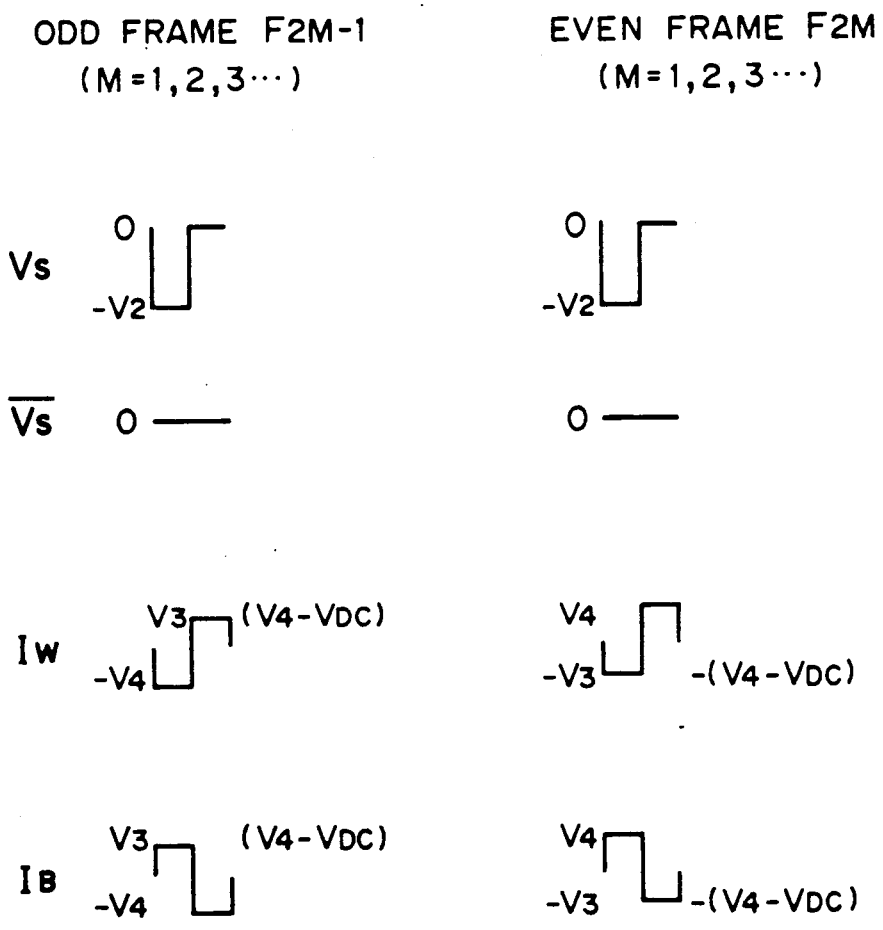
FIG. 21A shows a set of driving voltage waveforms used in an embodiment of the invention.
Figure 21B:
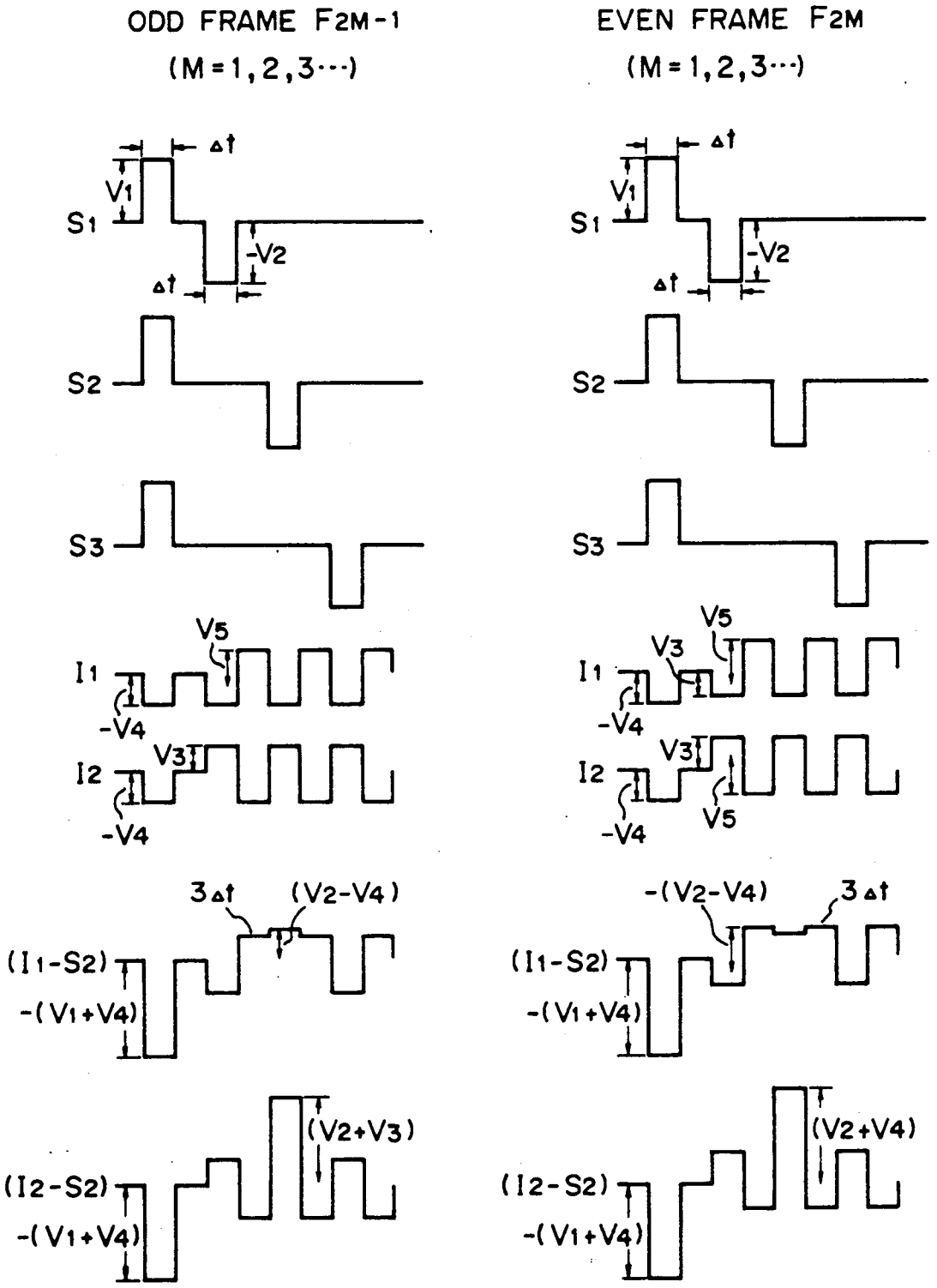
FIG. 21B shows examples of time-serial continuation thereof.

FIGS. 21A and 21B illustrate an embodiment used in the invention.

The driving signals shown in FIG. 21A include a scanning selection signal $V_S$, a scanning nonselection signal $\bar{V}_S$, a data non-selection signal $I_W$ corresponding to "white" ("W") signal, and a data selection signal $I_B$ corresponding to "black" ("B") signal. The data signals comprise alternating voltages having peak values $|\pm V_3|$ and $|\pm V_4|$ satisfy the relationship of $|\pm V_3| < |\pm V_4|$. FIG. 21B shows an embodiment wherein a data line $I_1$ is supplied with "W"-"W"-"W" signals and a data line $I_2$ is supplied with "B"-"B"-"B" signals. In the embodiment shown in FIGS. 21A and 21B, the polarity of the DC component applied to pixels is inverted in a cycle of one frame, whereby a good display state is realized over a long period in spite of the presence of 3Δt crosstalk.

It is suitable to set the magnitude of the DC offset voltage $V_{DC}$ to a value in the range of ±0.5% to ±10.0%, preferably ±1.0% to ±5.0%, of the maximum voltage amplitude applied to the pixels.

Figure 22:
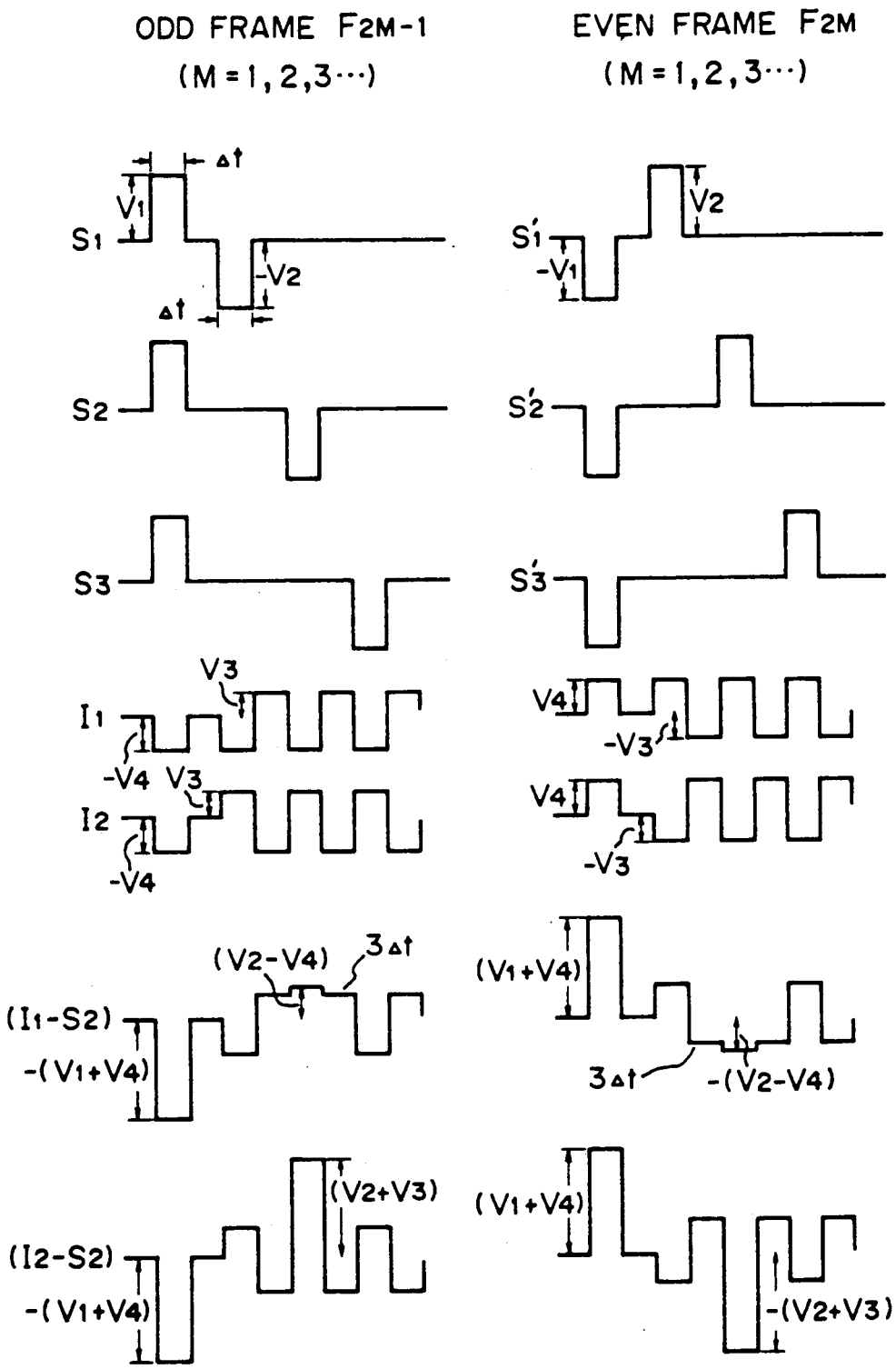

FIG. 22 shows a modification of the embodiment shown in FIGS. 21A and 21B. In the embodiment shown in FIG. 22, the polarity of the DC offset voltage $V_{DC}$ is inverted at each frame period, and in phase therewith, the polarity of the scanning selection signal in a particular phase is inverted. In this instance, the voltage polarities applied to the scanning electrodes and the data electrodes at the erasure step are also inverted at each frame period.

In a particular embodiment operated by using the driving waveforms shown in FIG. 22 under the conditions of Δt=40 μsec, $|\pm V_1| = |\pm V_2| = 18$ volts $|\pm V_3| = 8$ volts, and $|\pm V_4| = 9$ volts, a good display free of panel crosstalk was obtained for a long period.

FIGS. 23 and 24 respectively show another set of driving waveforms used in the invention. In the embodiments shown in FIGS. 23 and 24, the polarity of the DC offset voltage $V_{DC}$ is inverted at a cycle of one frame period and one scanning selection period.

Figure 25A:
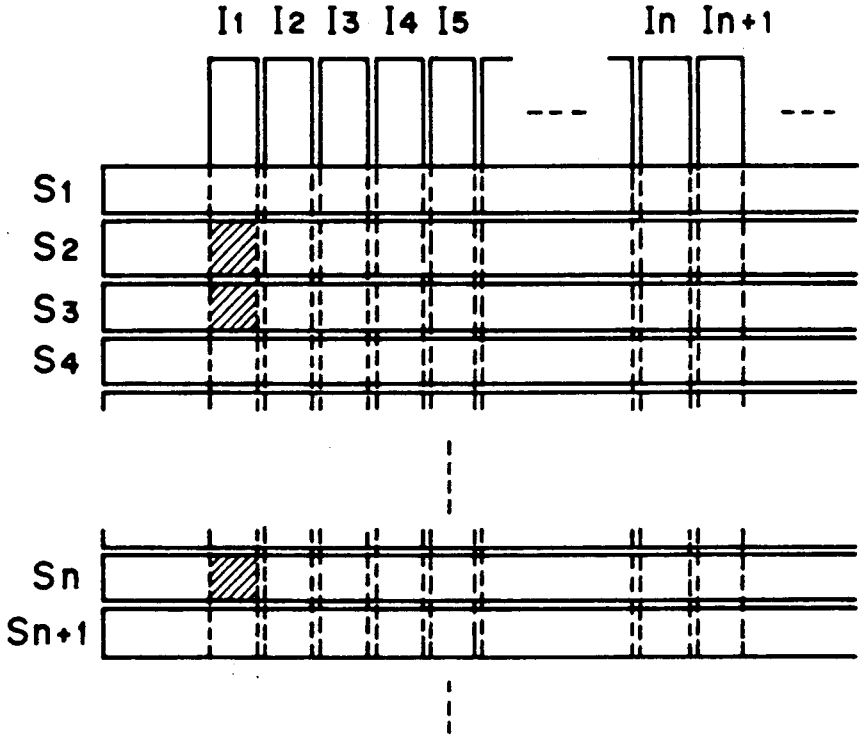
FIG. 25A is a plan view of a matrix electrode arrangement used in the invention.
Figure 25B:
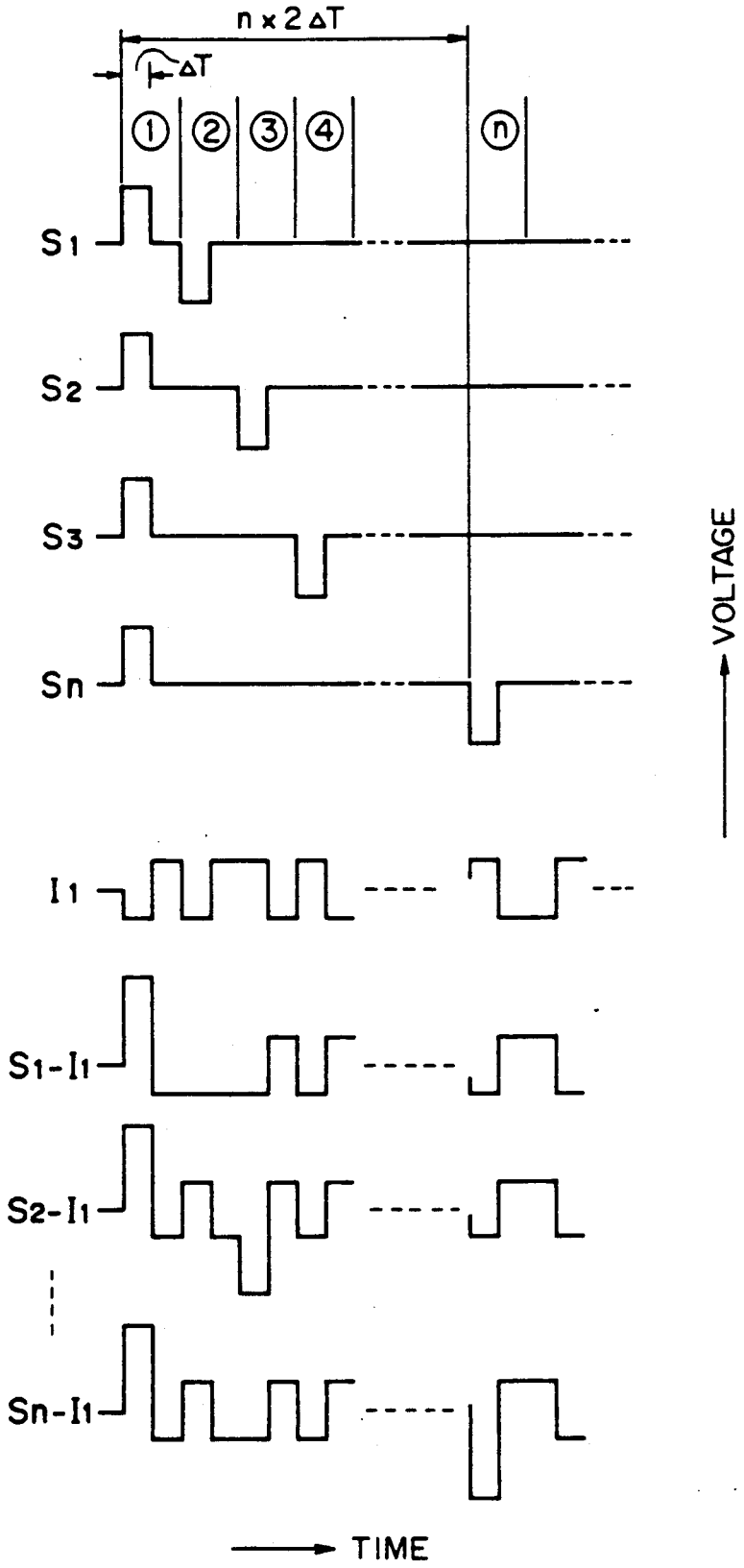
FIG. 25B and 26 respectively show driving waveforms used in the invention.

In still another embodiment of the invention, a set of driving waveform as shown in FIG. 25B are applied to a liquid crystal cell structure having a matrix electrode arrangement shown in FIG. 25A. More specifically, FIG. 25B shows a signal waveform applied to a data line $I_1$, signal waveforms applied to scanning lines $S_1$-$S_n$ intersecting with the data lines, and voltages applied to the liquid crystal as a combination of the signals. According to the driving waveforms shown in FIG. 25B, an arbitrary plurality of scanning lines are supplied with a positive (upward in the figure) writing pulse in a first phase (1 in the figure) to uniformly write in one state (e.g., "white"), and then pixels on a first scanning line selected in a second phase (2) are selectively transformed into the other state (e.g., "black") depending on waveforms applied to the data lines concerned. In the embodiment shown in FIG. 25B, a pixel supplied with voltages shown at ($S_1$-$I_1$) receives voltages for retaining "white" after being written into "white". Thereafter, the scanning lines are sequentially selected to apply "white" and "black" image signals selectively to display a picture. For writing "black", as shown at ($S_2$-$I_1$), a negative voltage exceeding the threshold voltage is applied.

In the above embodiment, the voltages of the data signals are set to $\pm V_0$ and the voltage applied to the scanning lines are set to $\pm 2V_0$. If the voltage value required for switching is referred to as Vsat at a pulse duration $\Delta T$, the voltages may be set to satisfy the relationship of $V_0 < Vsat < 3V_0$.

When an FLC device is actually driven by applying the above set of driving waveforms based on the above, there has been found a problem of failure to effect a desired display as follows.

Thus, a pixel shown at ($S_1$-$I_1$), immediately after the inversion, receives a pulse of the opposite polarity which is below the threshold but is continual ($4\Delta T$, $-V_0$). The voltage is applied with an intention of holding the "white" state after writing into "white" by application of a positive pulse of $\Delta T$ and $3V_0$ but it may well be expected that the voltage pulse of $4\Delta t$ and $-V_0$ can cause a crosstalk.

Figure 26:
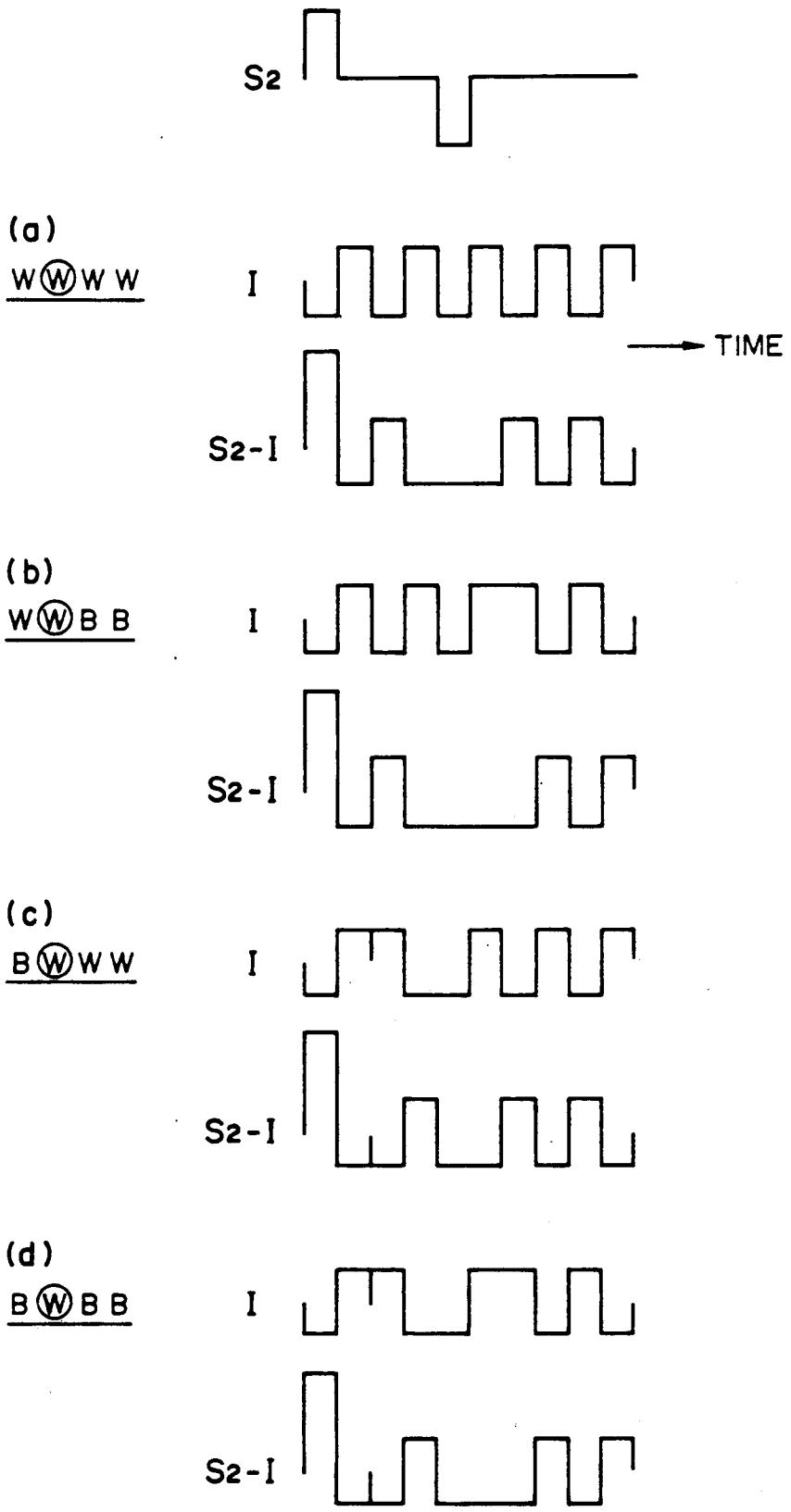

More specifically, in the case of "white" writing followed by holding of the "white" state, the number of repetition of the pulse below the threshold varies depending on a given image pattern. For the purpose of further generalization, for example, a second scanning line $S_2$ is noted in the case of simultaneous erasure of plural lines with reference to FIG. 26, which is a view showing voltage waveforms applied to a pixel $S_2$-I among pixels of particular attention at intersections of a data line and scanning lines $S_1$-$S_4$ For example, as shown at (a) in FIG. 26 in case where pixels at the intersections of I with $S_1$, $S_2$ and $S_3$ are written in "W"-"W"-"W", respectively, the pixel $S_2$-I is supplied with a negative pulse of $3\Delta t$ and $-V_0$. Further, at (b), (c) and (d) in FIG. 26, voltages applied to the pixels $S_2$-I are shown in the cases of writing "W"-"W"-"B", "B"-"W"-"W", and "B"-"W"-"B", respectively, in the same pixels at the intersections of I with $S_1$, $S_2$, $S_3$. As shown at FIG. 26, (b), a negative pulse of $4\Delta T$ and $-V_0$ is applied to the pixel $S_2$-I. In this way, there is a case where it is difficult to retain the "white" state depending on given image pattern.

It may well be supposed that a crosstalk of inversion into "black" can be caused during the application of a waveform for holding the "white" state (hereinafter called "half-selection waveform"). In a specific embodiment, a liquid crystal panel of the following composition was driven by such driving waveforms:

Liquid crystal panel

Liquid crystal: CS 1014 (available from Chisso K.K.)
Alignment film: PVA films, both rubbed
Cell thickness: 1.8 μm
Numbers of scanning lines and data lines: 100×100

Under the conditions of $\Delta T = 100$ μsec, a voltage applied to a scanning line of $\pm 2V_0 = \pm 14$ volts and a voltage applied to a data line of $\pm V_0 = +7$ volts, a relatively good image was displayed, which however was blurred when carefully observed. As a result of fine observation, it was caused by inversion of "white" into "black" when a data line was supplied with a continuation of signals for writing "W"-"W"-"W"-"B"-"B"-"B". More specifically, it was found that the last "W", i.e., "W" adjacent to the first "B" was inverted into "B" as a result of crosstalk at the pixel concerned.

It is an object of the invention to remove the crosstalk. This is accomplished by shifting the average value of the voltage applied to the liquid crystal toward the "white" side, i.e., toward a positive polarity in the waveform ($S_1$-$I_1$) in FIG. 25B. More specifically, the data signal is caused to have voltages of $V_0$ and $-V_0+\Delta V$ to remove the crosstalk at the time of half-selection.

Figure 27:
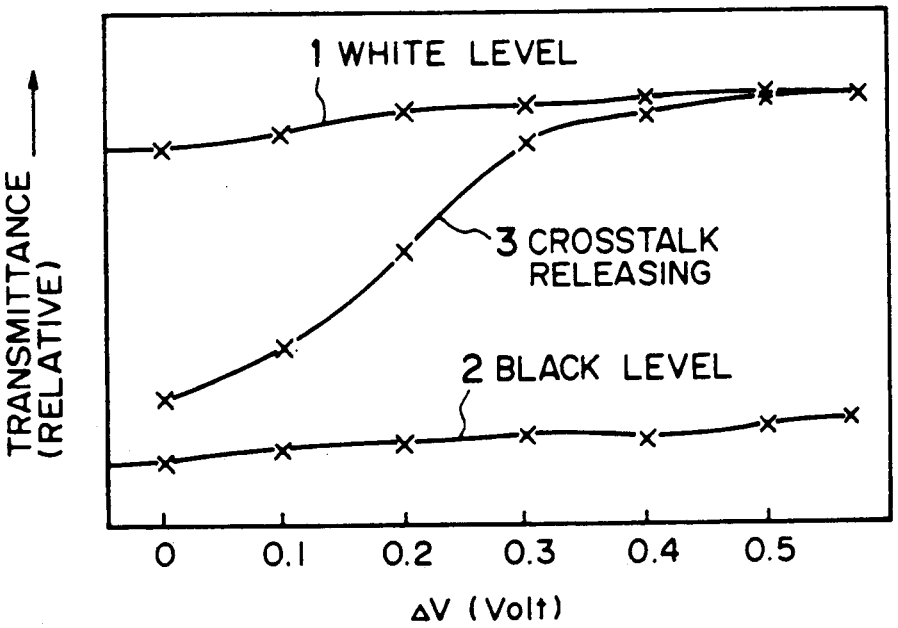
FIG. 27 is a characteristic diagram showing a correlation between T (transmittance) and $\Delta V$ (voltage).

FIG. 27 is a graph showing the degree of prevention of crosstalk, wherein the abscissa represents the DC component $\Delta V$ of data signals and the ordinate represents a transmitted light quantity. The curve 1 represents the transmittance of a pixel on a data line receiving a continuation of white signals; the curve 2 represents the transmittance of a cell receiving a continuation of black signal. The positions of the cross nicol polarizers are set optimally at the respective voltages. The curve 3 represents the transmittance of a pixel of half-selection (to be written in "white") adjacent to black pixels. The results in FIG. 27 show that desired writing was effected when $\Delta V$ was about 0.3 V.

Example 1

Optimum conditions for scanning line voltages $V_1$, $V_2$ and data line voltages $V_3$, $V_4$ were found to be as follows in case of $\Delta T = 100$ μsec by using the above-mentioned liquid crystal panel and driving waveforms:

$V_1 = 11.0$ *volts*, $V_2 = -11.0$ *volts*, $V_3 = 5.0$ *volts*, $V_4 = -5.3$ *volts*.

Example 2

Such optimum conditions were found to be as follows in case of $\Delta T = 50$ μsec:

$V_1 = 22.0$ *volts*, $V_2 = -22.0$ *volts*

$V = 10.0$ *volts*, $V_4 = -10.5$ *volts*.

Example 3

Figure 28:
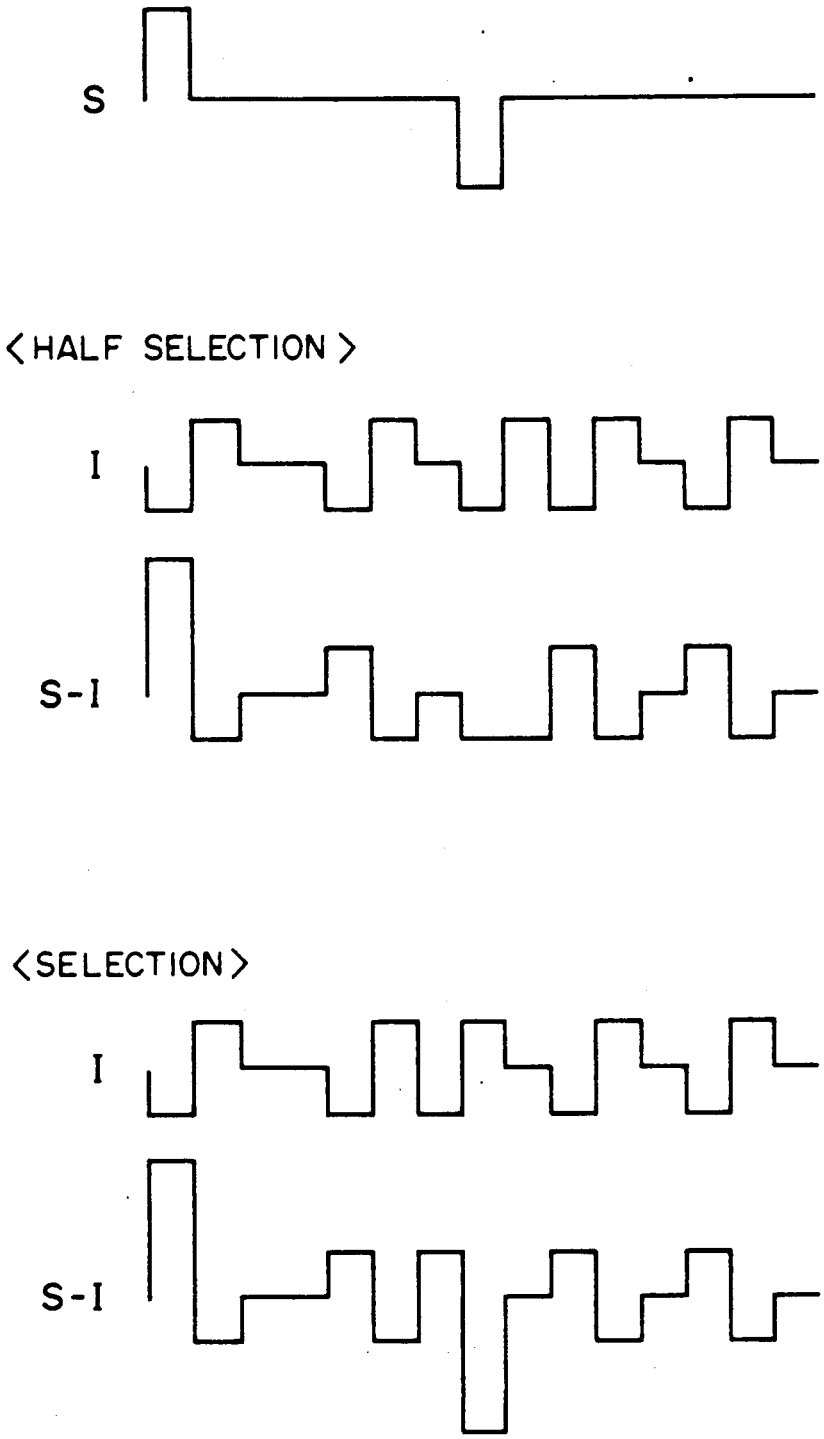
FIG. 28 shows driving waveforms used in the invention.

Optimum conditions for scanning line voltages $V_1$, $V_2$ and data line voltages $V_3$, $V_4$ were measured in case of $\Delta T = 100$ μsec by using the above-mentioned liquid crystal device and driving waveforms shown in FIG. 28, wherein similarly pixels on a plurality of scanning lines were written into one state and the scanning lines were sequentially selected for addressing of image data. The results were as follows:

$V_1 = 10.0$ *volts*, $V_2 = -10.0$ *volts*, $V_3 = 5.1$ *volts*, $V_4 = -5.3$ *volts*.

Example 4

Similarly as Example 3, the optimum conditions were measured to be as follows in case of $\Delta T = 50$ μsec:

$V_1 = 20.0$ *volts*, $V_2 = -20.0$ *volts*, $V_3 = 9.3$ *volts*, $V_4 = -9.8$ *volts*.

As the ferroelectric liquid crystal showing bistability or multi-stability used in the present invention, chiral smectic liquid crystals having ferroelectricity are most preferred. Among these liquid crystals, a liquid crystal in chiral smectic C phase (SmC*) or H phase (SmH*) is particularly suited. These ferroelectric liquid crystals are described in, e.g., "LE JOURNAL DE PHYSIQUE LETTERS" 36 (L-69), 1975 "Ferroelectric Liquid Crystals": "Applied Physics Letters" 36 (11) 1980, "Submicro-Second Bistable Electrooptic Switching in Liquid Crystals", "Kotai Butsuri (Solid State Physics)" 16 (141), 1981 "Liquid Crystal". Ferroelectric liquid crystals disclosed in these publications may be used in the present invention.

More particularly, examples of ferroelectric liquid crystal compound used in the present invention are decyloxybenzylidene-p'-amino-2-methylbutylcinnamate (DOBAMBC), hexyloxy-benzylidene-p'-amino-2-chloropropylcinnamate (HOBACPC), 4-O-(2-methyl)-butylrecorsilicene-4'-octylaniline (MBRA 8), etc.

When a device is constituted using these materials, the device may be supported with a black of copper, etc. in which a heater is embedded in order to realize a temperature condition where the liquid crystal compounds assume an SmC*- or SmH*-phase.

Further, in the present invention, it is possible to use a ferroelectric liquid crystal in chiral smectic F phase, I phase, G phase or K phase in addition to the above mentioned SmC* and SmH* phases.

Figure 29:
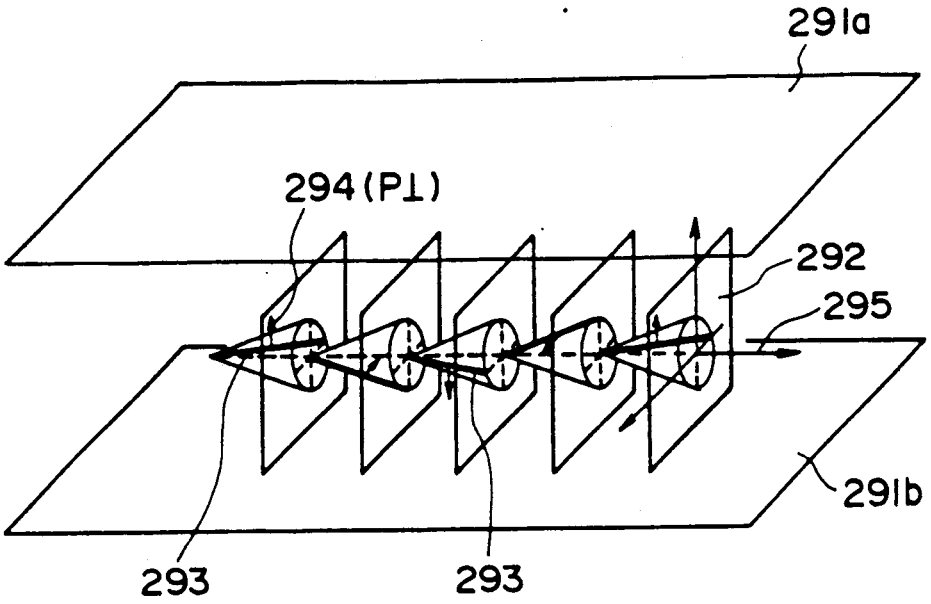
FIGS. 29 and 30 are schematic perspective views showing an FLC device used in the invention.
Figure 30:
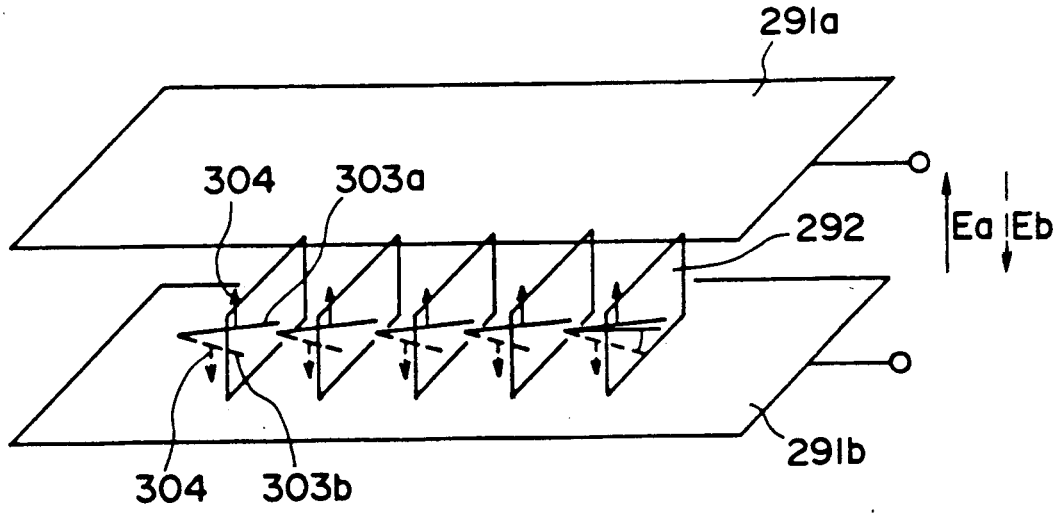

Referring to FIG. 29, there is schematically shown an example of a ferroelectric liquid crystal cell. Reference numerals 291*a* and 291*b* denote base plates (glass plates) on which a transparent electrode of, e.g., $In_2O_3$, $SnO_2$, ITO (Indium-Tin-Oxide), etc., is disposed, respectively. A liquid crystal of an SmC*-phase in which liquid crystal molecular layers 292 are oriented perpendicular to surfaces of the glass plates is hermetically disposed therebetween. A full line 293 shows liquid crystal molecules. Each liquid crystal molecule 293 has a dipole moment ($P_\perp$) 294 in a direction perpendicular to the axis thereof. When a voltage higher than a certain threshold level is applied between electrodes formed on the base plates 291*a* and 291*b*, a helical or spiral structure of the liquid crystal molecule 293 is unwound or released to change the alignment direction of respective liquid crystal molecules 293 so that the dipole moment ($P_\perp$) 294 are all directed in the direction of the electric field. The liquid crystal molecules 293 have an elongated shape and show refractive anisotropy between the long axis and the short axis thereof. Accordingly, it is easily understood that when, for instance, polarizers arranged in a cross nicol relationship, i.e., with their polarizing directions crossing each other, are disposed on the upper and the lower surfaces of the glass plates, the liquid crystal cell thus arranged functions as a liquid crystal optical modulation device of which optical characteristics vary depending upon the polarity of an applied voltage. Further, when the thickness of the liquid crystal cell is sufficiently thin (e.g., 1 $\mu$), the helical structure of the liquid crystal molecules is released without application of an electric field whereby the dipole moment assumes either of the two states, i.e., Pa in an upper direction 304*a* or Pb in a lower direction 304*b*, thus providing a bistability condition, as shown in FIG. 30. When an electric field Ea or Eb higher than a certain threshold level and different from each other in polarity as shown in FIG. 30 is applied to a cell having the above-mentioned characteristics, the dipole moment is directed either in the upper direction 304*a* or in the lower direction 304*b* depending on the vector of the electric field Ea or Eb. In correspondence with this, the liquid crystal molecules are oriented to either a first orientation state 303*a* or a second orientation state 303*b*.

When the above-mentioned ferroelectric liquid crystal is used as an optical modulation element, it is possible to obtain two advantages. First is that the response speed is quite fast. Second is that the orientation of the liquid crystal shows bistability. The second advantage will be further explained, e.g., with reference to FIG. 30. When the electric field Ea is applied to the liquid crystal molecules, they are oriented in the first stable state 303*a*. This state is stably retained even if the electric field is removed. On the other hand, when the electric field Eb of which direction is opposite to that of the electric field Ea is applied thereto, the liquid crystal molecules are oriented to the second orientation state 303*b*, whereby the directions of molecules are changed. Likewise, the latter state is stably retained even if the electric field is removed. Further, as long as the magnitude of the electric field Ea or Eb being applied is not above a certain threshold value, the liquid crystal molecules are placed in the respective orientation states. In order to effectively realize high response speed and bistability, it is preferable that the thickness of the cell is as thin as possible and generally 0.5 to 20$\mu$, particularly 1 to 5$\mu$.

As described above, according to the present invention, a ferroelectric liquid crystal device can be driven with a temperature compensation over the whole operational temperature range without remarkably changing the frame frequency or driving voltage and also at low voltages.

Further, according to the temperature compensation of the present invention, failure of inversion during driving is minimized to decrease irregularity in contrast over the entire picture, so that a high display quality can be maintained over the entire operational temperature region even where there is a difference in threshold voltage for the respective pixels. The temperature compensation method is especially effective for a liquid crystal material which is liable to cause crosstalk or has a large temperature-dependency of driving voltage.

Further, the present invention provides a good display free of panel crosstalk for a long period of time in multiplexing drive of a ferroelectric liquid crystal device.

What is claimed is:

1. A liquid crystal apparatus, comprising:

a liquid crystal device comprising scanning electrodes, data electrodes and a ferroelectric liquid crystal disposed between the scanning electrodes and the data electrodes, the ferroelectric liquid crystal having a first threshold voltage of one polarity for switching into a first optical state and a second threshold voltage of the other polarity for switching into a second optical state;

means for applying a scanning selection signal and a scanning nonselection signal to the scanning electrodes, said scanning selection signal having a voltage of one polarity and a voltage of the other polarity;

means for (1) applying to all or a prescribed number of the data electrodes a first voltage signal providing a first voltage difference applied to the ferroelectric liquid crystal between the voltage signal and the voltage of one polarity, the first voltage difference exceeding the first threshold voltage of the ferroelectric liquid crystal, (2) applying to a selected data electrode a second voltage signal providing a second voltage difference applied to the ferroelectric liquid crystal between the second voltage signal and the voltage of the other polarity, the second voltage difference exceeding the second threshold voltage of the ferroelectric liquid crystal, and (3) applying to the other data electrodes a third voltage signal providing a third voltage difference applied to the ferroelectric liquid crystal between the third voltage signal and the voltage of the other polarity, the third voltage difference being between the first and second threshold voltages of the ferroelectric liquid crystal;

means for superposing a DC offset voltage having the same polarity as the one polarity of the scanning selection signal on the first, second and third voltage signals applied to the data electrodes; and means for increasing the magnitude of the superposed DC offset voltage in accordance with an increase in operational temperature of the ferroelectric liquid crystal device, wherein the voltage polarities being defined with respect to the voltage level of the scanning non-selection signal.

2. An apparatus according to claim 1, wherein the magnitude of the superposed DC offset voltage is increased continuously in accordance with the increase in operational temperature of the ferroelectric liquid crystal device.

3. An apparatus according to claim 1, wherein the magnitude of the superposed DC offset voltage is increased stepwise in accordance with the increase in operational temperature of the ferroelectric liquid crystal device.

4. An apparatus according to claim 1, wherein the first, second, and third voltage signals applied to the data line, each comprise a voltage of one polarity and a voltage of the other polarity with respect to the voltage level of a non-selected scanning line, and the voltages of one and the other polarities are mutually unsymmetrical.

5. An apparatus according to claim 1, wherein said ferroelectric liquid crystal comprises a chiral smectic liquid crystal.

6. An apparatus according to claim 5, wherein said chiral smectic liquid crystal is disposed in a layer thin enough to release its own helical structure in the absence of an electric field applied thereto.

7. A liquid crystal apparatus, comprising:

a liquid crystal device comprising scanning electrodes, data electrodes and a ferroelectric liquid crystal disposed between the scanning electrodes and the data electrodes, the ferroelectric liquid crystal having a first threshold voltage of one polarity for switching into a first optical state and a second threshold voltage of the other polarity for switching into a second optical state means for applying a clearing voltage of one polarity exceeding the first threshold voltage of the ferroelectric liquid crystal to all or a prescribed number of the scanning electrodes;

means for applying a scanning selection signal having a voltage of the other polarity and a scanning non-selection signal to the scanning electrodes;

means for (1) applying to a selected data electrode a first voltage signal providing a first voltage difference applied to the ferroelectric liquid crystal between the first voltage signal and the voltage of the other polarity, the first voltage difference exceeding the second threshold voltage of the ferroelectric liquid crystal, and (2) applying to the other data electrodes a second voltage signal providing a second voltage difference applied to the ferroelectric liquid crystal between the second voltage signal and the voltage of the other polarity, the second voltage difference being between the first and second threshold voltages of the ferroelectric liquid crystal;

means for superposing a DC offset voltage having the same polarity as the one polarity of the clearing voltage on the first and second voltage signals applied to the data electrodes; and means for increasing the magnitude of the superposed DC offset voltage in accordance with an increase in operational temperature of the ferroelectric liquid crystal device.

wherein the voltage polarities being defined with respect to the voltage level of the scanning non-section signal.

8. An apparatus according to claim 7, wherein the magnitude of the superposed DC offset voltage is increased continuously in accordance with the increase in operational temperature of the ferroelectric liquid crystal device.

9. An apparatus according to claim 7, wherein the magnitude of the superposed DC offset voltage is increased stepwise in accordance with the increase in operational temperature of the ferroelectric liquid crystal device.

10. An apparatus according to claim 7, wherein the first and second voltage signals applied to a data line, each comprise a voltage of one polarity and a voltage of the other polarity with respect to the voltage level of a non-selected scanning line, and the voltages of one and the other polarities are mutually unsymmetrical.

11. An apparatus according to claim 7, wherein said scanning selection signal comprises a voltage of one polarity at a former half thereof and a voltage of the other polarity at a latter half thereof with respect to the voltage level of the scanning non-selection signal.

12. An apparatus according to claim 11, wherein the first voltage signal applied to the selected data electrode comprises a voltage having a polarity opposite to that of the voltage of the scanning selection signal in the same phase.

13. An apparatus according to claim 7, wherein said ferroelectric liquid crystal comprises a chiral smectic liquid crystal.

14. An apparatus according to claim 13, wherein said chiral smectic liquid crystal is disposed in a layer thin enough to release its own helical structure in the absence of an electric field applied thereto.

15. In a liquid crystal apparatus, comprising: a liquid crystal device comprising scanning electrodes, data electrode intersecting with the scanning electrodes, and a ferroelectric liquid crystal disposed between the scanning electrodes and the data electrodes; the ferroelectric liquid crystal having a first threshold voltage of one polarity for switching into a first optical state and a second threshold voltage of the other polarity for switching into a second optical state; and voltage application means, the improvement wherein said voltage application means includes means for applying a scanning selection signal and a scanning non-selection signal to the scanning electrodes, the scanning selection signal having a voltage of one polarity and a voltage of the other polarity, means for applying data signals to the data electrodes in phase with the scanning selection signal so as to apply an AC voltage to the intersections of the scanning electrodes and the data electrodes, means for superposing a DC offset voltage of a polarity on the AC voltage applied to the intersections, of the scanning electrodes and the data electrodes, means for increasing the magnitude of the DC offset voltage in accordance with an increase in operational temperature of the ferroelectric liquid crystal device, and means for inverting the polarities of the DC offset voltage and the scanning selection signal for each one scanning selection period for applying a scanning selection signal to one scanning electrode, or one cycle period for applying a scanning selection signal to all or a prescribed number of the scanning electrodes.

16. An apparatus according to claim 15, wherein each of the data signals comprises a voltage of one polarity and a voltage of the other polarity with respect to the voltage level of a non-selected scanning electrode, and the voltages of one and the other polarities have mutually different peak values.

17. An apparatus according to claim 15, wherein the one cycle period for inversion of the DC voltage polarity corresponds to the period of one frame or one field.

18. An apparatus according to claim 15, wherein said ferroelectric liquid crystal comprises a chiral smectic liquid crystal.

19. An apparatus according to claim 18, wherein said chiral smectic liquid crystal is disposed in a layer thin enough to release its own helical structure in the absence of an electric field applied thereto.

20. A liquid crystal apparatus, comprising:

a liquid crystal device comprising scanning electrodes and data electrodes intersecting with the scanning electrode, and a chiral smectic liquid crystal disposed between the scanning electrodes and the data electrodes, the chiral smectic liquid crystal having a first threshold voltage of one polarity for switching into a first optical state and a second threshold voltage of the other polarity for switching into a second optical state; and voltage application means for:

applying a scanning selection signal and a scanning non-selection signal to the scanning electrodes, the scanning selection signal having a voltage of one polarity and a voltage of the other polarity, applying data signals to the data electrodes in phase with the scanning selection signal so as to apply an AC voltage to the intersections of the scanning electrodes and the data electrodes, superposing a DC offset voltage on the AC voltage applied to the intersections of the scanning electrodes and the data electrodes, and changing the DC offset voltage in accordance with a change in operational temperature of the chiral smectic liquid crystal device.

21. An apparatus according to claim 20, wherein each of the data signals comprises a voltage of one polarity and a voltage of the other polarity with respect to the voltage level of a non-selected scanning electrode, and the voltages of one and the other polarities have mutually different peak values.

* * * * *